US008511675B2

(12) United States Patent
Yamagishi et al.

(10) Patent No.: US 8,511,675 B2
(45) Date of Patent: Aug. 20, 2013

(54) SHEET FEEDING DEVICE AND IMAGE FORMING APPARATUS INCLUDING THE SAME

(75) Inventors: Masayuki Yamagishi, Kanagawa (JP); Satoru Ishii, Kanagawa (JP); Kenichi Ishikura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/310,470

(22) Filed: Dec. 2, 2011

(65) Prior Publication Data

US 2012/0306148 A1 Dec. 6, 2012

(30) Foreign Application Priority Data

May 31, 2011 (JP) ..... 2011-121862

(51) Int. Cl.
*B65H 1/08* (2006.01)

(52) U.S. Cl.
USPC ..... 271/126; 271/123; 271/127; 271/148; 271/169

(58) Field of Classification Search
USPC ..... 271/126, 127, 148, 161, 167, 169, 271/170, 123, 109, 121, 122, 145
See application file for complete search history.

(56) References Cited

U.S. PATENT DOCUMENTS

| | | | | |
|---|---|---|---|---|
| 5,931,455 | A * | 8/1999 | Okui et al. | 271/127 |
| 6,629,693 | B2 * | 10/2003 | Siow et al. | 271/171 |
| 2005/0189698 | A1 | 9/2005 | Somemiya | |
| 2008/0088080 | A1 * | 4/2008 | Liu et al. | 271/127 |

FOREIGN PATENT DOCUMENTS

JP 2005-154076 A 6/2005

* cited by examiner

*Primary Examiner* — Jeremy R Severson
(74) *Attorney, Agent, or Firm* — Sughrue Mion, PLLC

(57) ABSTRACT

A sheet feeding device includes a sheet storing portion storing sheets stacked on a stacking surface thereof; a feeding roller feeding each of the sheets by rotating while being in contact with a topmost one of the sheets; a support member having a support surface that supports downstream-side part, in a sheet feeding direction, of the sheets and, at the time of sheet feeding, being movable perpendicularly to the stacking surface while lifting the downstream-side part of the sheets with the topmost sheet kept in contact with the feeding roller; and a stopper member configured to come into contact with leading ends of some sheets to be fed by the feeding roller and to stop sheets other than the topmost sheet. The support surface of the support member slopes upward, with respect to the stacking surface, toward a downstream side in the sheet feeding direction.

22 Claims, 35 Drawing Sheets

SHEET FEEDING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2011-121862 filed May 31, 2011.

BACKGROUND (i) Technical Field

The present invention relates to a sheet feeding device and an image forming apparatus including the same.

(ii) Related Art

An image forming apparatus including an image forming section configured to form an image, such as characters, figures, patterns, and pictures, on a sheet includes or is used with a sheet feeding device configured to feed sheets one by one to the image forming section. An exemplary sheet feeding device employs a method in which sheets stacked on a stacking surface of a sheet storing portion are sequentially fed from the topmost one of the sheets by a feeding device. The sheets, i.e., recording media having specific dimensions, may be plain paper, coated paper, specialty paper, thin paper, cardboards, postcards, or the like.

If the image forming apparatus is demanded to be small, the sheet feeding device included in or used with the image forming apparatus is also demanded to be small, usually. There are some related-art sheet feeding devices that meet such a demand for smallness.

A related-art sheet feeding device employs a support member having a support surface that supports leading-end part, in a sheet feeding direction, of a stack of sheets placed on a stacking surface of a sheet storing portion. At the time of sheet feeding, the support member is lifted in a direction perpendicular to the stacking surface, thereby lifting the leading-end part of the stack of sheets and retaining the leading-end part of the topmost one of the sheets to be pressed against a feeding roller of a feeding device. In this case, the feeding device may also include a stopper member (such as a separation roller) that is provided in contact with the feeding roller and stops sheets other than the topmost sheet that have been moved by the feeding roller from being fed.

SUMMARY

According to an aspect of the invention, there is provided a sheet feeding device including a sheet storing portion having a stacking surface and in which sheets are stacked on the stacking surface; a feeding roller configured to feed each of the sheets in the sheet storing portion by rotating while being in contact with a topmost one of the sheets; a support member having a support surface that supports downstream-side part, in a sheet feeding direction in which the feeding roller feeds the sheet, of the sheets in the sheet storing portion from below a bottommost one of the sheets and being movable in a perpendicular direction with respect to the stacking surface such that the support surface comes into contact with and moves away from the feeding roller, the support member moving in the perpendicular direction at the time of sheet feeding in such a manner as to lift the downstream-side part of the sheets in the sheet storing portion; and a stopper member out of contact with the support member but in contact with the feeding roller, the stopper member being configured to come into contact with leading ends of some sheets to be fed by the feeding roller and to stop sheets other than the topmost sheet from being fed. The support surface of the support member forms a sloping surface that slopes upward, with respect to the stacking surface, toward a downstream side in the sheet feeding direction.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the accompanying drawings.

First Exemplary Embodiment

Figure 1:
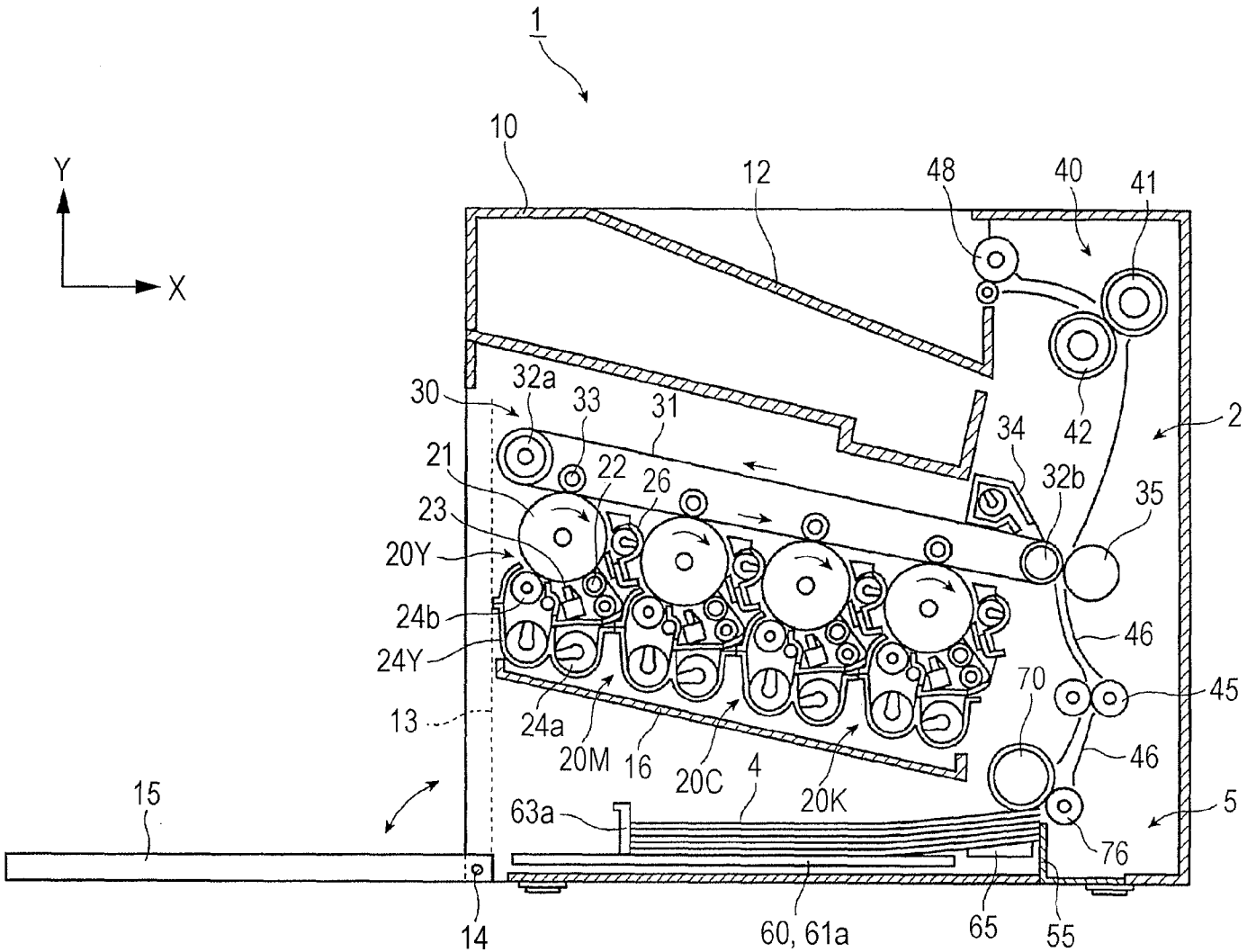
FIG. 1 is a schematic sectional view of an image forming apparatus including a sheet feeding device according to any of first and other exemplary embodiments.
Figure 2:
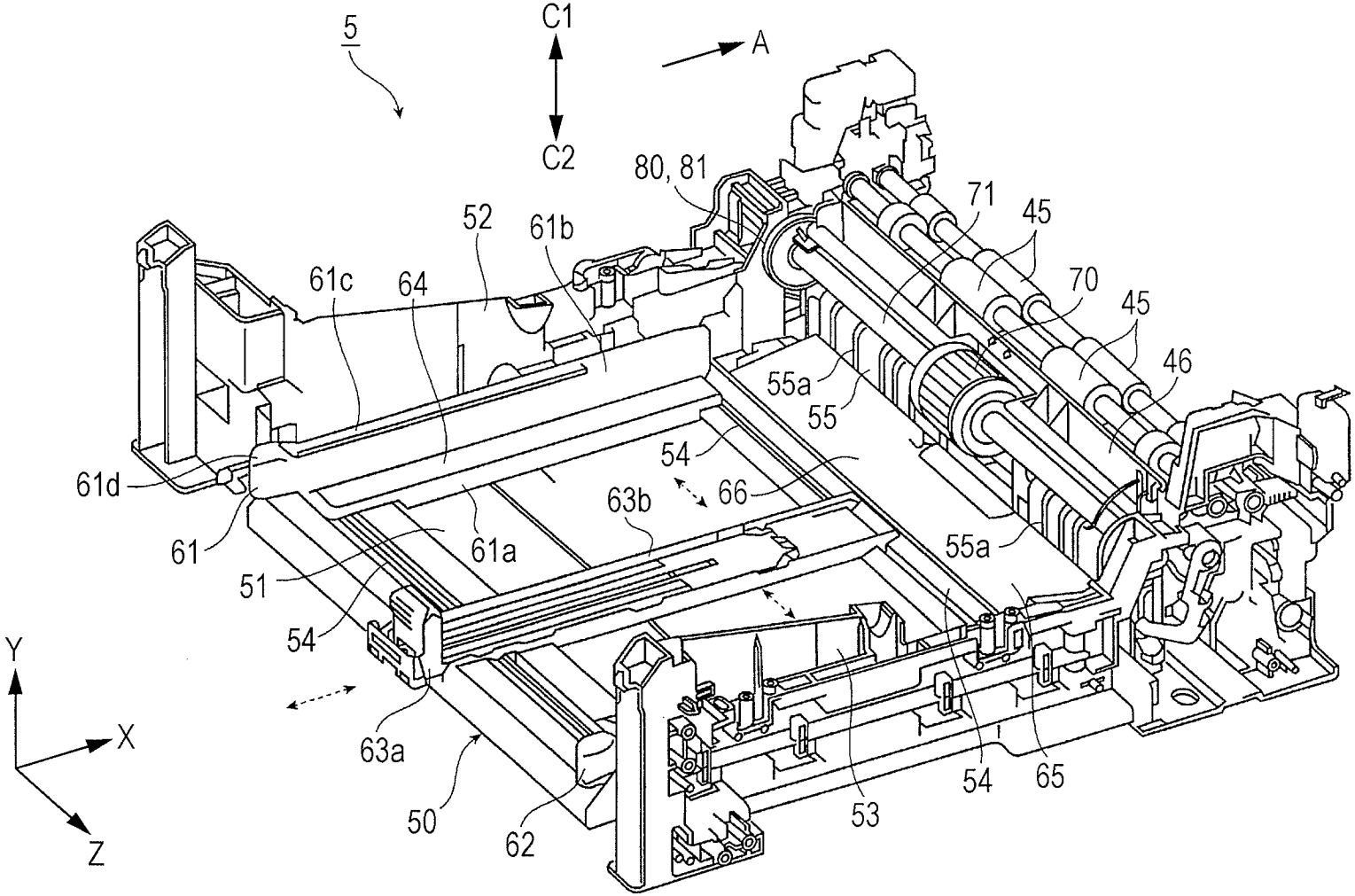
FIG. 2 is a perspective view of the sheet feeding device included in the image forming apparatus illustrated in FIG. 1.

FIGS. 1 and 2 illustrate an image forming apparatus 1 employing a sheet feeding device 5 according to a first exemplary embodiment. FIG. 1 illustrates the image forming apparatus 1 including the sheet feeding device 5. FIG. 2 illustrates the sheet feeding device 5. Arrows X, Y, and Z illustrated in the drawings represent the coordinate axes. The directions of the coordinate axes X, Y, and Z correspond to "the anteroposterior direction", "the vertical direction", and "the horizontal direction", respectively, of the image forming apparatus 1 (the sheet feeding device 5) that has been properly installed and is ready to be used.

The image forming apparatus 1 includes an apparatus body 10 made of supporting structural material, exterior material, or the like. The apparatus body 10 has a box-like appearance in its entirety with a specific space provided therein. The top surface of the apparatus body 10 forms an output-paper-receiving portion 12 that receives each sheet having been output with an image formed thereon. The apparatus body 10 also has in lower part of one side face thereof (front lower part of the apparatus 1) an opening 13 through which the inside thereof is exposed to the outside. An openable/closable covering 15 opens/closes the opening 13 by turning about a hinge (shaft) 14 as indicated by the arrow.

The image forming apparatus 1 includes the sheet feeding device 5 at the bottom of the apparatus body 10. The sheet feeding device 5 stores recording sheets 4 on which images are to be formed individually, and sequentially feeds the sheets 4 one by one to a feed destination. The sheet feeding device 5 feeds each of the sheets 4 along a sheet transport path defined by parts such as pairs of transport rollers 45 and a sheet transport guide member 46 toward a second transfer position defined in an image forming section 2 described separately below. The pairs of transport rollers 45 function as transport-timing-adjusting rollers. Details of the sheet feeding device 5 will be described separately below.

The image forming apparatus 1 further includes imaging devices 20, an intermediate transfer unit 30, a fixing device 40, and so forth that are housed in the apparatus body 10 and collectively function as the image forming section 2. The imaging devices 20 include four imaging devices 20Y, 20M, 20C, and 20K that form developer images (toner images) in four respective colors of yellow (Y), magenta (M), cyan (C), and black (K). The imaging devices (Y, M, C, and K) according to the first exemplary embodiment are arranged such that their positions become higher in order of black, cyan, magenta, and yellow (in a state where a unit of imaging devices 20 as a whole extends at a specific angle).

The imaging devices 20 (Y, M, C, and K) include respective photoconductor drums 21 (Y, M, C, and K) as image carriers that rotate as indicated by the arrows (in the clockwise direction in FIG. 1), respective charging devices 22 that charge the surfaces of the photoconductor drums 21, respective optical writing devices 23 as latent-image-forming devices, respective developing devices 24 (Y, M, C, and K), and respective drum cleaning devices 26 that remove toners and the like remaining on the surfaces of the photoconductor drums 21 after transfer. As illustrated in FIG. 1, a partition plate 16 separates the sheet feeding device 5 and the imaging devices 20 from each other.

The photoconductor drums 21 each include a cylindrical base member on the circumferential surface of which a photosensitive layer composed of organic photosensitive material or the like is provided. The charging devices 22 each include a charging roller that rotates while being in contact with the surface of a corresponding one of the photoconductor drums 21 with a charging voltage being applied thereto. The optical writing devices 23 are each an exposure device including a light-emitting diode (LED), an optical element, or the like. Image signals are transmitted to the optical writing devices 23 from an image processing unit that performs specific processing on image information having been input to the image forming apparatus 1.

The developing devices 24 each perform contact magnetic-brush reversal development as follows. A two-component developer, for example, composed of toner and carrier is agitated by an agitating transport member 24*a* in a developer container of the developing device 24. Subsequently, while a development roller 24*b* to which a development voltage is being applied rotates at a position close to a development area of a corresponding one of the photoconductor drums 21, the developer is carried and transported by the development roller 24*b*. The drum cleaning devices 26 each include a cleaning member, such as an elastic blade. The cleaning member is brought into contact with the surface of a corresponding one of the photoconductor drums 21, whereby each drum cleaning device 26 collects toner and the like removed by the cleaning member.

The imaging devices 20 (Y, M, C, and K) form an image in the following manner. First, in the imaging devices 20 (Y, M, C, and K), the surfaces of the photoconductor drums 21 that are rotating are charged with specific potentials by the charging devices 22. Subsequently, the charged photoconductor drums 21 are exposed to light emitted from the optical writing devices 23 on the basis of respective image signals. Thus, electrostatic latent images of different color components having specific potentials are formed on the surfaces of the respective photoconductor drums 21. Subsequently, the electrostatic latent images of different color components on the photoconductor drums 21 are developed with different-colored developers supplied from the respective developing devices 24, whereby toner images in four respective colors are formed. The toner images on the photoconductor drums 21 are first-transferred to an intermediate transfer belt 31 of the intermediate transfer unit 30 as follows.

The intermediate transfer unit 30 includes the intermediate transfer belt 31, which is an endless belt and to which the toner images in the respective colors formed on the photoconductor drums 21 of the imaging devices 20 (Y, M, C, and K) are transferred, plural support rollers 32*a* and 32*b* that support and rotate the intermediate transfer belt 31 such that the intermediate transfer belt 31 that is in contact with the photoconductor drums 21 sequentially passes the photoconductor drums 21, first transfer devices 33 that first-transfer the respective toner images on the photoconductor drums 21 to the outer circumferential surface of the intermediate transfer belt 31, and a belt cleaning device 34 that removes toners and the like remaining on the outer circumferential surface of the intermediate transfer belt 31 after the transfer.

One of the plural support rollers 32*a* and 32*b*, specifically, the support roller 32*b*, functions as a driving roller and rotates the intermediate transfer belt 31 as indicated by the arrows (in the counterclockwise direction in FIG. 1) by receiving a rotational driving force transmitted thereto from a rotary drive device (not illustrated). The first transfer devices 33 are provided in the forms of first transfer rollers 33 that are in contact with the inner circumferential surface of the intermediate transfer belt 31 and rotate while causing the outer circumferential surface of the intermediate transfer belt 31 to be pressed against the surfaces of the photoconductor drums 21. In this state, first transfer voltages are applied to the first transfer rollers 33.

In the intermediate transfer unit 30, the toner images are electrostatically first-transferred by the first transfer rollers 33 from the photoconductor drums 21 of the imaging devices 20 (Y, M, C, and K) to the outer circumferential surface of the intermediate transfer belt 31 rotating as indicated by the arrows. Thus, the intermediate transfer belt 31 carries on the outer circumferential surface thereof a toner image as a combination of the different colored toner images that are registered with one another or a monochrome toner image (for example, a black toner image in this case).

A second transfer device 35 second-transfers the toner image having been first-transferred to the outer circumferential surface of the intermediate transfer belt 31 to a sheet 4. The second transfer device 35 is provided in the form of a second transfer roller 35 that is in contact with part of the outer circumferential surface of the intermediate transfer belt 31 at a position opposite the support roller 32*b* and thus follows the rotation of the intermediate transfer belt 31. In this state, a second transfer voltage is applied to the second transfer device 35. The second transfer device 35 electrostatically second-transfers a yet-to-be-fixed toner image carried by the intermediate transfer belt 31 to a sheet 4 fed from the sheet feeding device 5 along the sheet transport path to the nip (the second transfer position) between the intermediate transfer belt 31 and the second transfer roller 35.

The fixing device 40 fixes the second-transferred but yet-to-be-fixed toner image to the sheet 4 and is provided above the second transfer device 35. The fixing device 40 includes a rotary heating member 41 and a pressure-applying rotary member 42. The rotary heating member 41 is provided in the form of a roller, a belt, or the like having a fixing surface that is heated to and is retained to be at a specific temperature by a heater. The pressure-applying rotary member 42 is provided in the form of a roller, a belt, or the like that is pressed against the fixing surface of the rotary heating member 41 at a specific pressure and forms a fix-processing portion therebetween. In the fixing device 40, the sheet 4 carrying the second-transferred but yet-to-be-fixed toner image is introduced into the fix-processing portion between the rotary heating member 41 and the pressure-applying rotary member 42 and is heated and pressed at the fix-processing portion, whereby the toners composing the toner image are melted and fixed to the sheet 4.

The sheet 4 having been subjected to the fixing performed by the fixing device 40 is released from the fixing device 40, is transported by an output roller 48, and is output to and received by the output-paper-receiving portion 12. Through the above process, a multicolor or monochrome image composed of developer is formed on one side of the sheet 4.

The sheet feeding device 5 will now be described.

Figure 4:
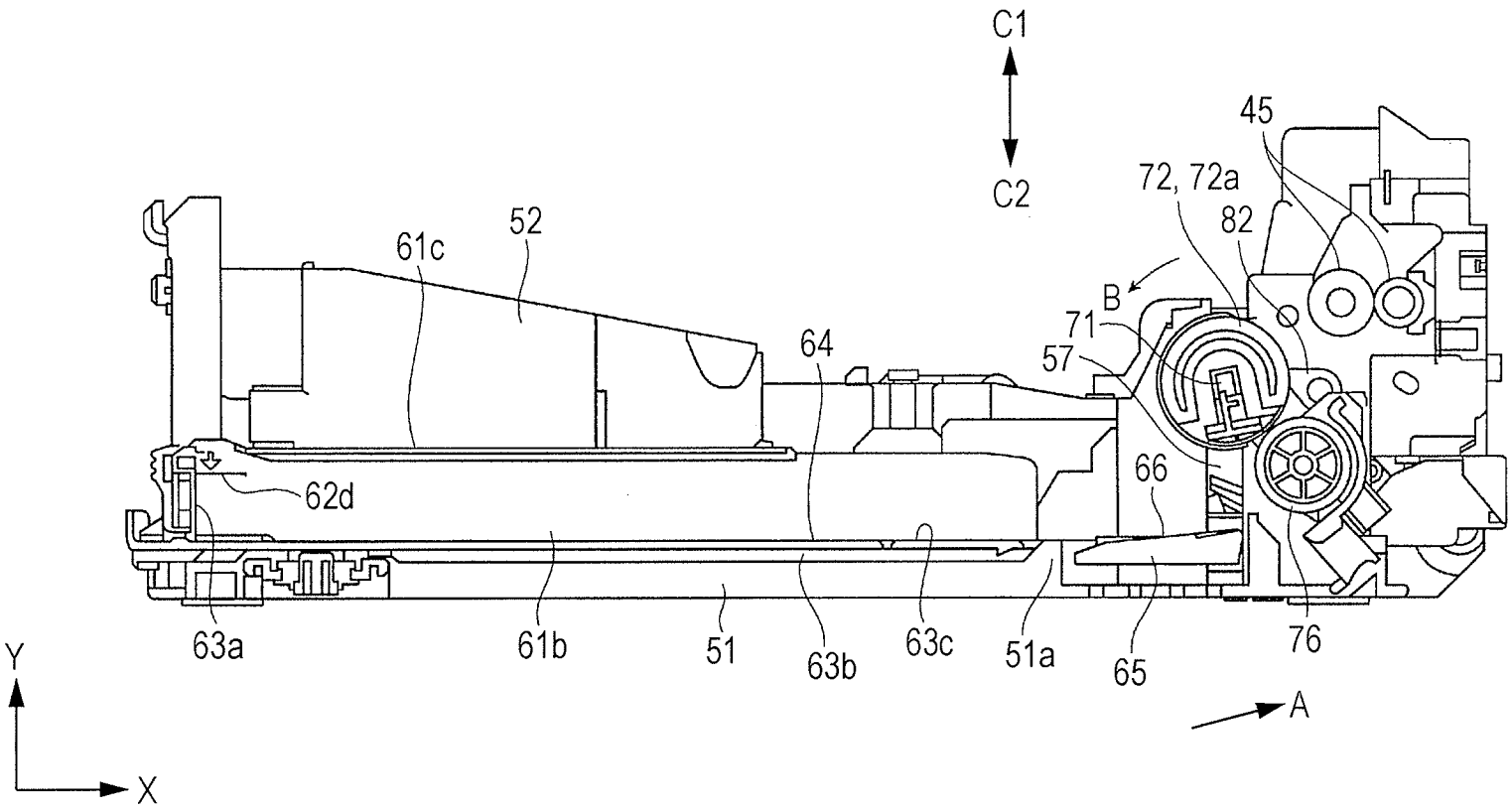
FIG. 4 is a sectional view of the sheet feeding device taken along line IV-IV illustrated in FIG. 3.

Referring to FIGS. 2, 4, and others, the sheet feeding device 5 includes a support structure 50, in which the following are basically provided: a sheet storing portion 60 that stores a stack of sheets 4; a feeding roller 70 that rotates while being in contact with a topmost sheet 4A of the stack of sheets 4 in the sheet storing portion 60 and thus feeds the topmost sheet 4A; a support plate 65 that supports and lifts downstream-side part 4S, in a direction A in which the feeding roller 70 feeds the sheet 4 (hereinafter referred to as the sheet feeding direction A), of the stack of sheets 4 stored in the sheet storing portion 60, the downstream-side part 4S being the leading ends of the sheets 4 at the time of sheet feeding, the support plate 65 retaining the downstream-side part 4S of the topmost sheet 4A to be in contact with the feeding roller 70; and a stopper roller 76 configured to come into contact with leading ends 4*a* of some sheets 4 to be fed by the feeding roller 70 and to stop sheets 4B other than the topmost sheet 4A from being fed.

The support structure 50 includes a bottom 51 having a substantially rectangular plan-view shape and left and right sidewalls 52 and 53 standing upward from the left and right edges, respectively, of the bottom 51. The support structure 50 according to the first exemplary embodiment forms part of the apparatus body 10 of the image forming apparatus 1. The support structure 50 further includes a leading-end-positioning plate 55 having a wall surface provided near the rear edge, in the anteroposterior direction X, of the bottom 51 and standing substantially perpendicularly to the bottom 51. The leading-end-positioning plate 55 positions the leading ends 4*a* of the sheets 4 stored in the sheet storing portion 60. The leading-end-positioning plate 55 has plural ribs (ridges) 55*a* provided at intervals and extending linearly in the direction perpendicular to the wall surface.

The sheet storing portion 60 is configured such that sheets 4 to be fed are stacked on the bottom 51 of the support structure 50 and in an area on the front side with respect to, and inclusive of, the leading-end-positioning plate 55. In the above area on the bottom 51 of the sheet storing portion 60, there are provided the leading-end-positioning plate 55, a pair of side positioning members 61 and 62 that position left and right sides 4*b* and 4*c* of the sheets 4 stored at the time of sheet feeding, and a trailing-end-positioning member 63 that positions trailing ends 4*d*, at the time of sheet feeding, of the sheets 4. The side positioning members 61 and 62 and the trailing-end-positioning member 63 are arranged such that a space for the support plate 65 is provided between the leading-end-positioning plate 55 and the positioning members 61, 62, and 63. The bottom 51 of the support structure 50 is provided with a bounding portion 51*a* projecting at the boundary between the support plate 65 and the side positioning members 61 and 62 and the trailing-end-positioning member 63 of the sheet storing portion 60 and linearly extending in the horizontal direction Z.

The side positioning members 61 and 62 have respective shapes that are symmetrical to each other. The specific shape of the left side positioning member 61 will now be described basically (since the entirety of the right side positioning member 62 is not illustrated in FIG. 2 and others, reference numerals of the right side positioning member 62 and parts associated therewith are hereinafter indicated with parentheses, according to need). The side positioning member 61 (62) includes a long and narrow plate-like base portion 61*a* (62*a*) having a flat stacking surface 64 on which sheets 4 are to be stacked, a long and narrow plate-like positioning surface portion 61*b* (62*b*) standing perpendicularly from the outer edge of the base portion 61*a* (62*a*) and being movable in such a manner as to come into contact with the left sides 4*b* (right sides 4*c*) of the sheets 4, and a top positioning portion 61*c* (62*c*) projecting inward from part of the top edge of the positioning surface portion 61*b* (62*b*) and extending substantially parallel to the stacking surface 64 in such a manner as to prevent, when the maximum storable number of sheets 4 are stored, the sheets 4 from being partially lifted.

The side positioning member 61 (62) has the base portion 61*a* (62*a*) thereof movably fitted in guide grooves 54 provided in the bottom 51 of the support structure 50, the guide grooves 54 extending linearly in the horizontal direction Z. The side positioning member 61 (62) is supported in such a manner as to be movable up to a position of contact with the left sides 4*b* (right sides 4*c*) of the sheets 4 stored and to be then held still at that position. When the side positioning member 61 is moved in the horizontal direction Z, the side positioning member 62 moves in conjunction therewith by the same length but in a direction opposite to the direction of movement of the side positioning member 61, and stops at a position that is symmetrical to the position of the side positioning member 61 with respect to the center in the horizontal direction Z. In FIG. 2 and others, a mark 61*d* indicates the expected position of the topmost sheet 4A when the maximum storable number of sheets 4 are stored. The stacking surface 64 of the base portion 61*a* (62*a*) is set so as to be at the same level as the top of the bounding portion 51*a* provided on the bottom 51 of the support structure 50 (see FIG. 4).

The trailing-end-positioning member 63 includes a plate-like positioning surface portion 63*a* and a long and narrow plate-like guiding track portion 63*b*. The positioning surface portion 63*a* has a positioning surface standing perpendicularly to the stacking surface 64 and is configured to come into contact with the trailing ends 4*d* of the sheets 4. The guiding track portion 63*b* is provided on the bottom 51 of the support structure 50 at substantially the center in the horizontal direction Z and extends in the anteroposterior direction X, thereby supporting the positioning surface portion 63*a* such that the positioning surface portion 63*a* is movable in the anteroposterior direction X. In the trailing-end-positioning member 63, the positioning surface portion 63*a* is attached to the guiding track portion 63*b* such that, after the positioning surface portion 63*a* is moved to a position of contact with the trailing ends 4*d* of the sheets 4 stored, the positioning surface portion 63*a* is held still at that position. In the trailing-end-positioning member 63 according to the first exemplary embodiment, a top edge 63*c* of the guiding track portion 63*b* linearly extends in the anteroposterior direction X and at the same level as the stacking surface 64 of the base portion 61*a* (62*a*) of the side positioning member (62) (see FIG. 4). Thus, the top edge 63*c* of the guiding track portion 63*b* also supports part of the stack of sheets 4 from below.

Referring to FIGS. 2 to 5 and others, in a state where the maximum storable number of sheets 4 are stacked on the stacking surface 64 of the base portion 61*a* (62*a*) of the side positioning member 61 (62) in the sheet storing portion 60, the feeding roller 70 resides at such a position as not to be in contact with the topmost sheet 4A of the stack of sheets 4 stored. The feeding roller 70 according to the first exemplary embodiment resides at a specific height from a downstream-side end 65*a* (see FIG. 11 and others), in the sheet feeding direction A, of the support plate 65 and at a position corresponding to the center of the support plate 65 in the horizontal direction Z.

Figure 3:
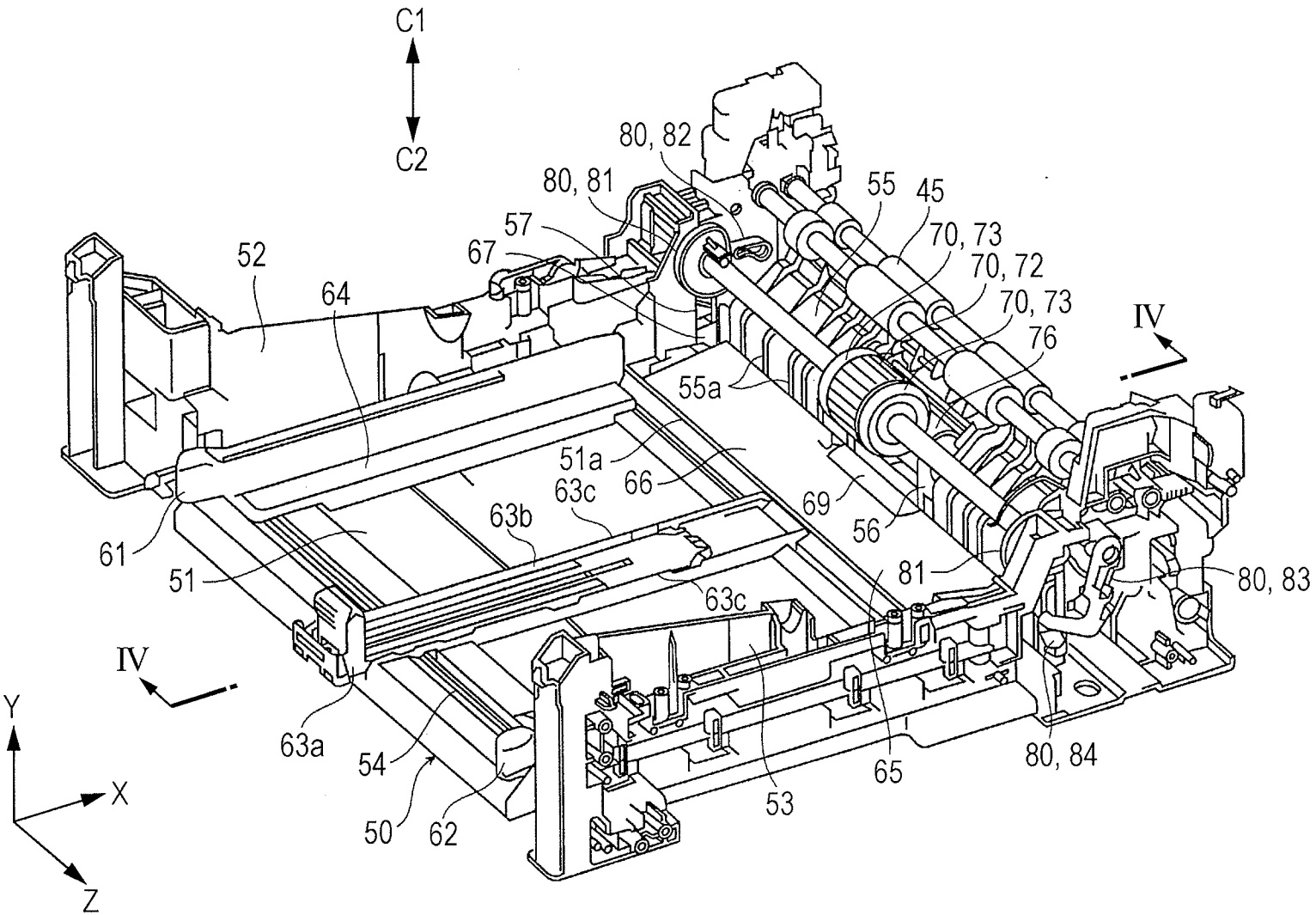
FIG. 3 is a perspective view of the sheet feeding device illustrated in FIG. 2 with a sheet transport guide member removed.
Figure 5:
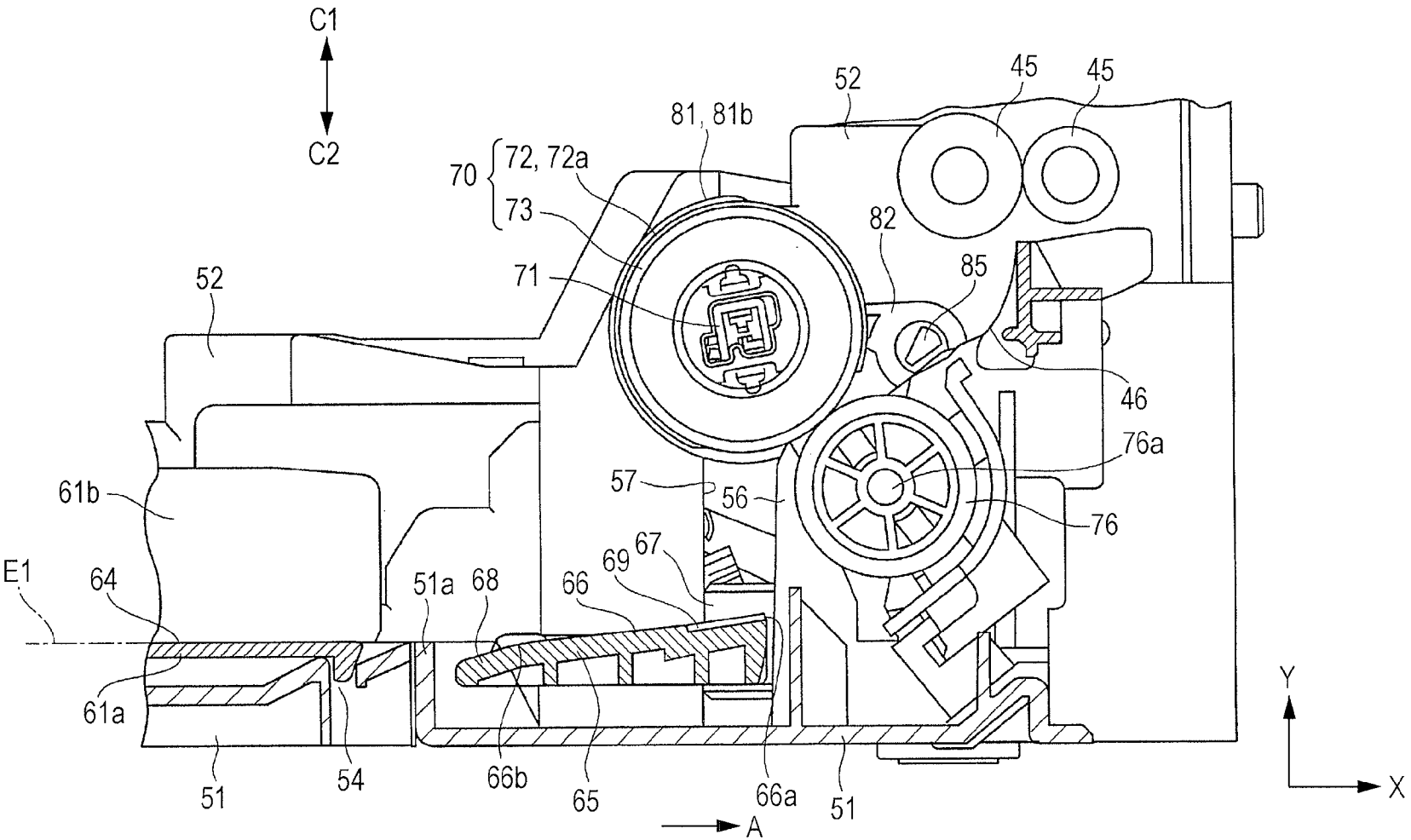
FIG. 5 is a sectional view illustrating relevant parts (a stacking surface, a feeding roller, a stopper roller, a support plate, and so forth) of the sheet feeding device illustrated in FIG. 3 that is in a standby state (a state where the support plate has been lowered to a standby position)

Referring to FIGS. 3, 5, and others, the feeding roller 70 includes a semilunar roller 72 and two assist rollers 73. The semilunar roller 72 has a semilunar shape (a shape of a round cylinder whose circumferential surface is partially cut off along a plane parallel to the center axis of the cylinder). The semilunar roller 72 is fixed to a rotating shaft 71 rotatably supported by the left and right sidewalls 52 and 53 of the support structure 50. The two assist rollers 73 are rotatably provided on the rotating shaft 71 and on both axial-direction sides of the semilunar roller 72. The semilunar roller 72 includes an arc-shaped roller surface 72*a* made of a material (for example, a rubber material) whose frictional resistance is higher than that of the surface of the sheet 4. The two assist rollers 73 each have a disc-like shape with a diameter slightly smaller than that of the semilunar roller 72.

When the sheet 4 is fed, the semilunar roller 72 is driven to rotate in a direction of rotation B for sheet feeding (the counterclockwise direction in FIG. 4 and others). In the driving of the semilunar roller 72, an intermittent rotational driving force is transmitted to the rotating shaft 71 from a rotary drive device (not illustrated), whereby the rotating shaft 71 rotates intermittently. The intermittent rotation is realized by, for example, a combination of a partially toothless gear and a state switching mechanism. The partially toothless gear has no gear teeth on part of the outer circumference thereof and is provided at one end of the rotating shaft 71. The state switching mechanism switches the state of meshing of the partially toothless gear with a driving gear rotated by the rotary drive device between a state where the gears mesh with each other and a state where the gears do not mesh with each other with the driving gear facing the toothless part of the partially toothless gear. The state switching mechanism that switches the state of the partially toothless gear between the above two states may be a combination of a spring member, such as a coil spring, that applies a force acting in such a direction as to rotate the partially toothless gear, a member that operates in such a manner as to retain the partially toothless gear to be in one of a rotatable state and a non-rotatable state, and an operation device, such as a solenoid, that causes the member to operate in the foregoing manner.

Referring to FIGS. 4, 5, and others, the stopper roller 76 is in contact with the circumferential surface of the feeding roller 70 at a specific pressure and at a position offset toward the downstream side in the sheet feeding direction A with respect to the position immediately below the feeding roller 70. The stopper roller 76 is configured such that a torque limiter included therein or provided thereto prevents a rotating shaft 76*a* thereof from rotating in a direction in which the rotating shaft 76*a* is expected to rotate (the clockwise direction in FIG. 4 and others) when the feeding roller 70 rotates in the direction of rotation B for sheet feeding. If, however, a torque larger than a preset value is applied from the feeding roller 70 (the semilunar roller 72) that is being driven to rotate in the direction of rotation B for sheet feeding, the stopper roller 76 rotates by following the rotation of the feeding roller 70. In the first exemplary embodiment, support plates 56 (see FIGS. 3, 5, and others) are provided on both sides and at respective distances from the two axial ends of the stopper roller 76 in such a manner as to support the sheet 4 that is fed by the feeding roller 70 from below at respective positions before a nip NP (see FIG. 11 and others) between the feeding roller 70 and the stopper roller 76. The support plates 56 stand from the bottom 51 of the support structure 50 at the respective positions before the nip NP between the feeding roller 70 and the stopper roller 76 and extend close to the surface of the feeding roller 70. The support plates 56 are plate members having the top ends thereof tapered off.

Referring to FIGS. 2, 3, and others, the support plate 65 is provided in the sheet storing portion 60 and between the leading-end-positioning plate 55 and the side positioning members 61 and 62. The support plate 65 is a plate-like member having a support surface 66 that supports the downstream-side part 4S, in the sheet feeding direction A, of the stack of sheets 4 placed over the stacking surfaces 64 of the side positioning members 61 and 62.

The support plate 65 according to the first exemplary embodiment includes a body having a substantially rectangular plan-view shape with guided portions 67 provided at two respective ends, in the longitudinal direction (the horizontal direction Z), of the body. The guided portions 67 are movably fitted in respective guide holes 57. The guide holes 57 are provided in the left and right sidewalls 52 and 53, respectively, of the support structure 50 at least in portions between the feeding roller 70 and the bottom 51 of the support structure 50 in such a manner as to extend in a direction C perpendicular to the stacking surfaces 64 of the side positioning members 61 and 62 (hereinafter referred to as the perpendicular direction C). Therefore, the support plate 65 having the guided portions 67 thereof fitted in the respective guide holes 57 is movable in its entirety in the perpendicular direction C by being guided along the guide holes 57.

The support plate 65 also has, at the downstream-side end 65*a* thereof in the sheet feeding direction A, grooves (not illustrated) into which the ribs 55*a* of the leading-end-positioning plate 55 fit. Referring to FIGS. 3, 4, and others, a braking member 69 exhibiting a larger frictional resistance than the surface of the sheet 4 has a width (the dimension in the longitudinal direction) slightly larger than the width of the feeding roller 70 in the axial direction. The braking member 69 is provided along the downstream-side edge, in the sheet feeding direction A, of the support surface 66 of the support plate 65 and substantially at the center of the support surface 66 in such a manner as to be substantially flush with the support surface 66.

The support plate 65 is movable up and down along the guide holes 57 in the perpendicular direction C with respect to the stacking surfaces 64 of the base portions 61*a* and 61*b* of the side positioning members 61 and 62 by a lifting/lowering mechanism 80 described below.

Figure 6:
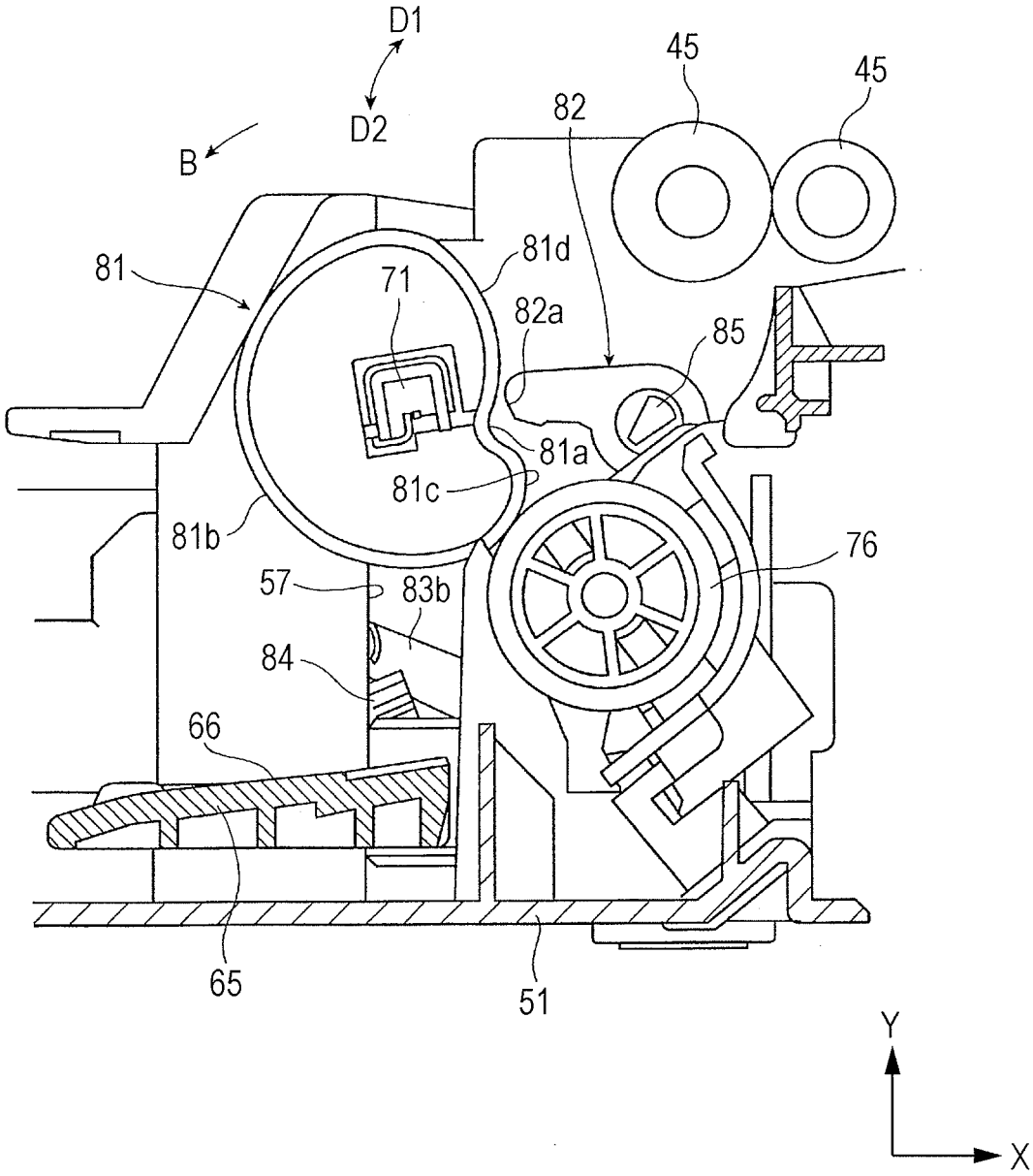
FIG. 6 is a sectional view illustrating relevant parts of the sheet feeding device illustrated in FIG. 5 with the feeding roller removed.
Figure 7:
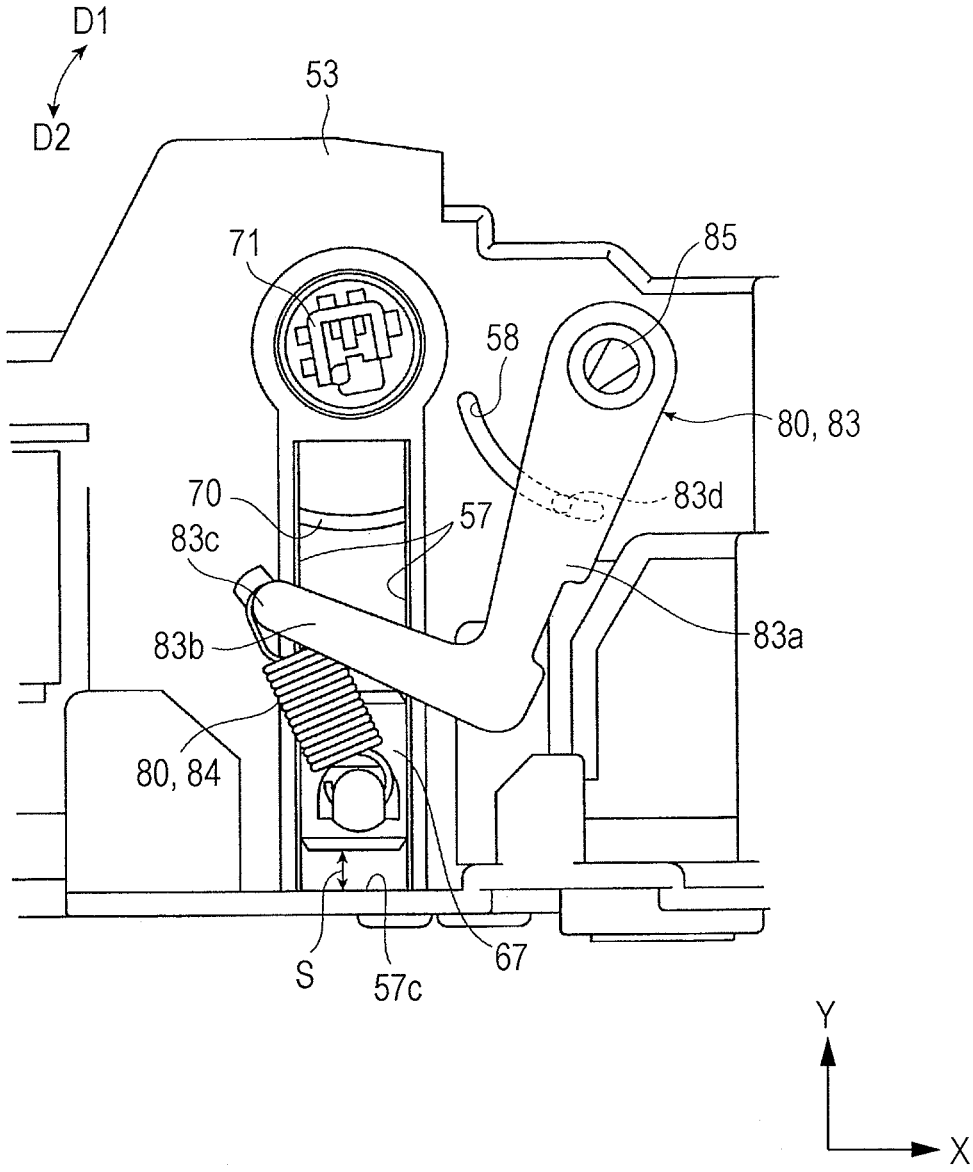
FIG. 7 is a side view illustrating relevant parts of the sheet feeding device illustrated in FIG. 5 seen from an outer lateral side.

Referring to FIGS. 5 to 7 and others, the lifting/lowering mechanism 80 includes cam members 81 fixed at two respective ends of the rotating shaft 71 of the feeding roller 70, follower members 82 movable by following the cam surfaces of the respective cam members 81, lifting/lowering drive members 83 producing a power (movement) for lifting/lowering the support plate 65 in the perpendicular direction C in response to the movements of the respective follower members 82, and transmitting members 84 variably transmitting the power produced by the lifting/lowering drive members 83 to the respective guided portions 67 of the support plate 65.

The cam members 81 are each a plate cam having a cam surface (outer circumferential surface) described below. Referring to FIG. 6 and others, the cam surface of each cam member 81 includes a smallest radius portion 81*a* at which the radial distance from the rotating shaft 71 (the cam radius) is the smallest, an arc-shaped portion 81*b* residing substantially on the opposite side of the smallest radius portion 81*a* with respect to the rotating shaft 71 and having an arc shape centered on the rotating shaft 71, a first curved portion 81*c* extending from the smallest radius portion 81*a* to one end of the arc-shaped portion 81*b* with the radial distance from the rotating shaft 71 increasing at a specific rate and thus forming a curved shape in its entirety, and a second curved portion 81*d* extending from the other end of the arc-shaped portion 81*b* to the smallest radius portion 81*a* with the radial distance from the rotating shaft 71 decreasing at a specific rate and thus forming a curved shape in its entirety.

The smallest radius portion 81*a* is used when the support plate 65 having been lowered is retained at a standby position. The first curved portion 81*c* is used when the support plate 65 is lifted from the standby position. The arc-shaped portion 81*b* is used when the support plate 65 having been lifted is retained to be lifted. The second curved portion 81*d* is used when the support plate 65 at the lifted position is lowered. The cam members 81 are fixed to the rotating shaft 71 and therefore rotate together with and in the same direction (the direction of rotation B for sheet feeding) as the rotating shaft 71, which is driven to rotate intermittently as described above.

The follower members 82 are fixed (on the inner sides of the sidewalls 52 and 53) to respective support shafts 85. The support shafts 85 are rotatably supported by the left and right sidewalls 52 and 53, respectively, of the support structure 50 and on the rear side of the image forming apparatus 1 with respect to the rotating shaft 71. Therefore, the follower members 82 are turnable. The follower members 82 each have a tip 82*a* thereof configured to come into contact with the cam surface of a corresponding one of the cam members 81. When the tip 82*a* faces the smallest radius portion 81*a* of the cam member 81, the tip 82*a* is not in contact with the smallest radius portion 81*a*. In the first exemplary embodiment, when the cam members 81 rotate in the direction of rotation B, the follower members 82 turn in a direction D about the respective support shafts 85.

The lifting/lowering drive members 83 are fixed to the support shafts 85, to which the follower members 82 are also fixed, on the outer sides of the sidewalls 52 and 53, respectively, thereby being turnable. The lifting/lowering drive members 83 each include an arm body portion 83*a* extending from a corresponding one of the support shafts 85 toward a corresponding one of the guided portions 67 of the support plate 65 and an arm bent portion 83*b* extending from the tip of the arm body portion 83*a* in a direction away from the guided portion 67 and toward the rotating shaft 71. Thus, each of the lifting/lowering drive members 83 has a substantially L shape in its entirety. The lifting/lowering drive members 83 and the follower members 82 are connected to each other with the support shafts 85 and are thus movable together. Therefore, when the follower members 82 turn in the direction D following the rotation of the cam members 81, the lifting/lowering drive members 83 turn in the direction D about the support shafts 85. The lifting/lowering drive members 83 according to the first exemplary embodiment are each set such that a tip 83*c* of the arm bent portion 83*b* is at the lowest position when a corresponding one of the follower members 82 faces the smallest radius portion 81*a* of a corresponding one of the cam members 81. As illustrated in FIG. 7 and others, the turnable range of each lifting/lowering drive member 83 is defined by a guide groove 58. The lifting/lowering drive member 83 has on the inner side of the arm body portion 83*a* thereof a guided projection 83*d* fitted in and guided along the guide groove 58. Thus, the turnable range of the lifting/lowering drive member 83 is defined by the guide groove 58.

The transmitting members 84 are coil springs. The coil springs as the transmitting members 84 (hereinafter also referred to as the coil springs 84) each have one end thereof hooked on the tip 83*c* of the arm bent portion 83*b* of a corresponding one of the lifting/lowering drive members 83 and the other end thereof hooked on a corresponding one of the guided portions 67 of the support plate 65. As illustrated in FIG. 7, in the first exemplary embodiment, when the follower members 82 face the smallest radius portions 81*a* of the respective cam members 81 and the tips 83*c* of the arm bent portions 83*b* of the lifting/lowering drive members 83 reside at the lowest positions, the coil springs 84 are retained in a non-expanded state or a slightly expanded state and the guided portions 67 of the support plate 65 are each retained at a distance S (to be lifted) from a lowest point 57*c* in a corresponding one of the guide holes 57. Thus, the position (standby position) of the support plate 65 when no sheets 4 are stored is determined. Furthermore, when a downward load (external force) is applied to the support plate 65, the support plate 65 is retained to be elastically lowerable in a downward direction (lowering direction) C2 corresponding to the perpendicular direction C against the tensile forces of the coil springs 84.

In this manner, the support plate 65 is supported with the guided portions 67 thereof being fitted in the respective guide holes 57 and is suspended from the lifting/lowering drive members 83 of the lifting/lowering mechanism 80 with the coil springs as the transmitting members 84 interposed therebetween. Furthermore, the support plate 65 is moved up and down with the turning of the lifting/lowering drive members 83 of the lifting/lowering mechanism 80 in the direction D realized by the follower members 82 that operate in conjunction with the cam actions of the cam members 81.

The operation of the support plate 65 realized by the lifting/lowering mechanism 80 will now be described.

When no sheets 4 are stored in the sheet storing portion 60 or no sheets 4 are to be fed (in a non-feeding state), the support plate 65 is retained at the standby position while being supported at the guide holes 57 as illustrated in FIGS. 4, 5, and others.

In this state, in the lifting/lowering mechanism 80, the cam members 81 stay still with the smallest radius portions 81*a* thereof facing the follower members 82 (see FIG. 6) and with the lifting/lowering drive members 83, which are connected to the follower members 82 with the support shafts 85, residing at the lowest positions (see FIG. 7). Thus, the support plate 65 is held at the standby position while being elastically hung, with the coil springs 84, from the arm bent portions 83*b* of the lifting/lowering drive members 83 residing at the lowest positions.

Figure 8:
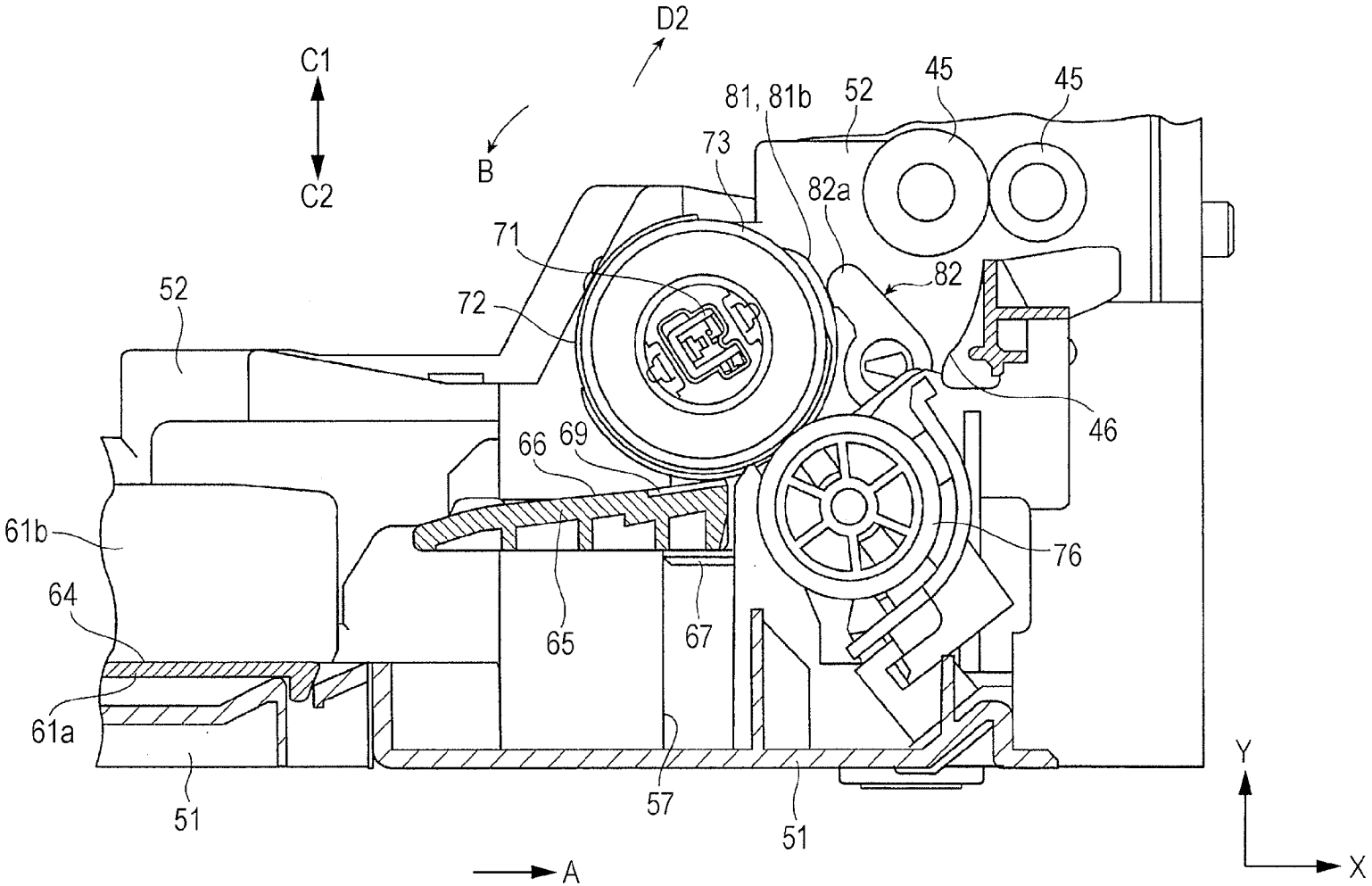
FIG. 8 is a sectional view illustrating relevant parts of the sheet feeding device illustrated in FIG. 3 with the support plate having been lifted.

When a sheet 4 is to be fed (in a feeding state), the lifting/lowering mechanism 80 performs a lifting operation and the support plate 65 is thus lifted from the standby position, while being guided along the guide holes 57 as illustrated in FIG. 8 and others, in a lifting direction C1 corresponding to the perpendicular direction C.

Figure 9:
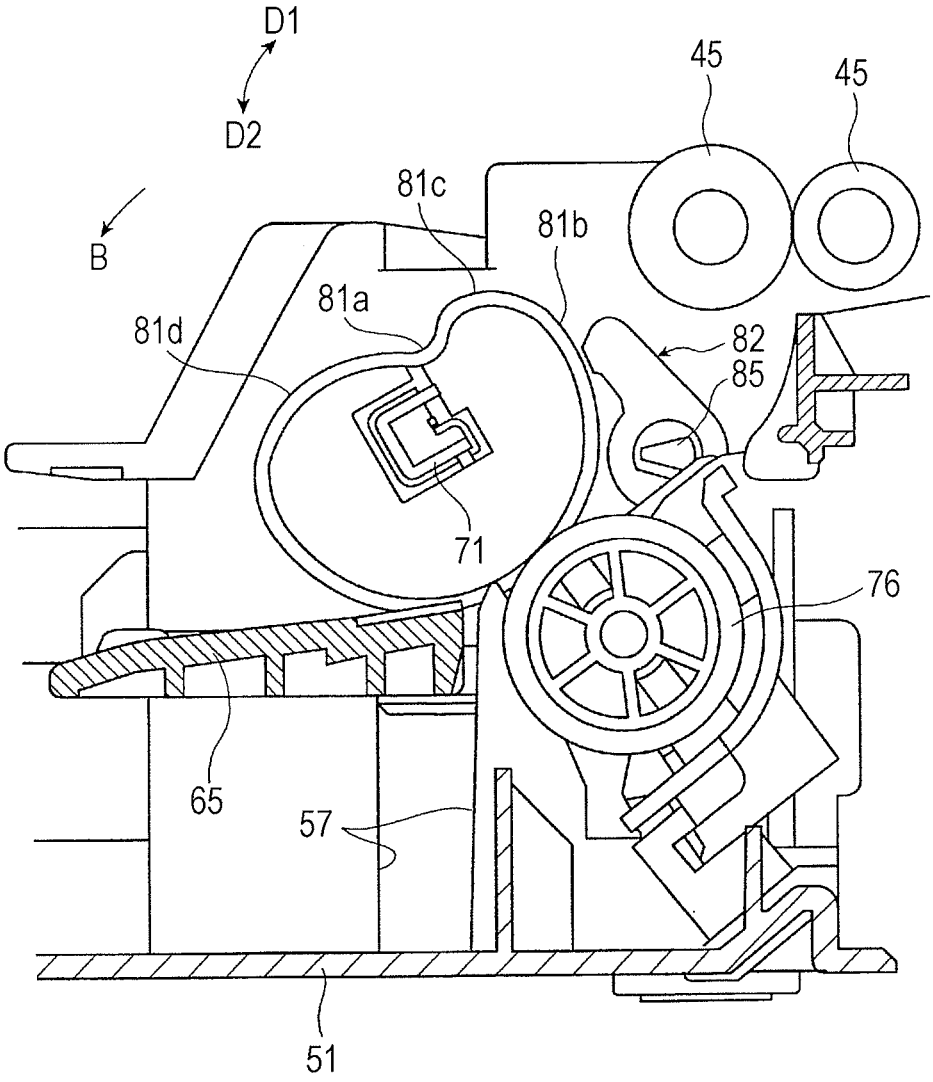
FIG. 9 is a sectional view illustrating relevant parts of the sheet feeding device illustrated in FIG. 8 with the feeding roller removed.
Figure 10:
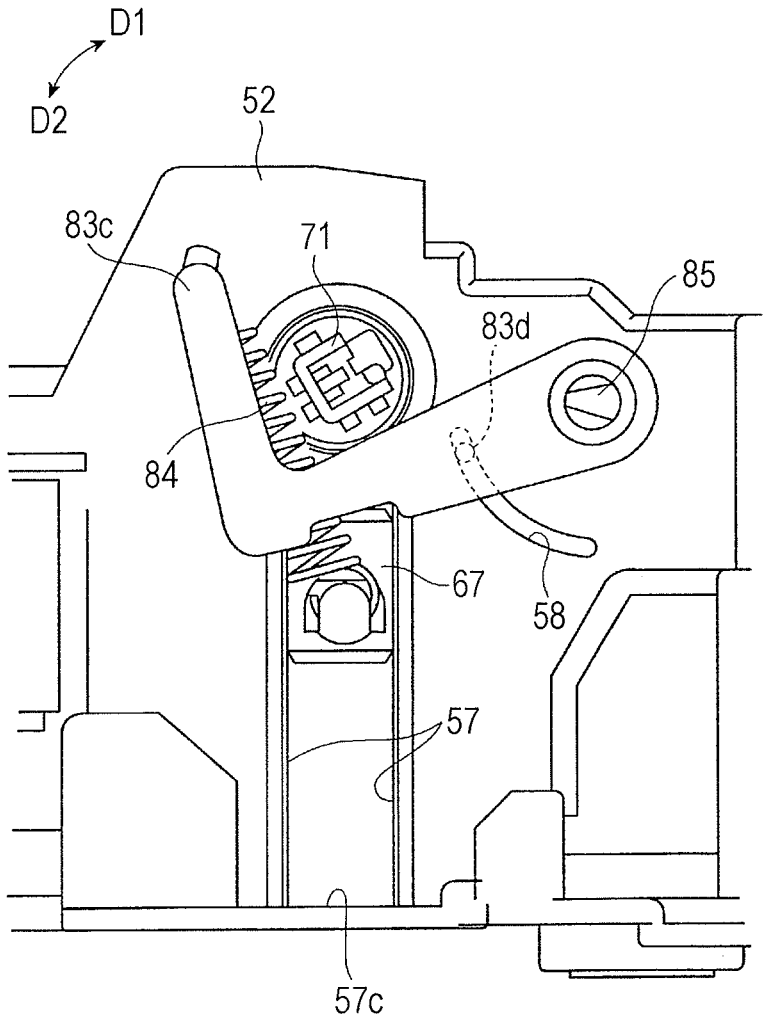
FIG. 10 is a side view illustrating relevant parts of the sheet feeding device illustrated in FIG. 8 seen from the outer lateral side.

In this operation, in the lifting/lowering mechanism 80, the cam members 81 start to rotate in the direction of rotation B together with the rotating shaft 71 that rotates so as to intermittently rotate the feeding roller 70, and the follower members 82 come into contact with the first curved portions 81*c* of the respective cam members 81 and thus turn upward in a direction D1 about the support shafts 85 (see FIG. 9). Accordingly, the lifting/lowering drive members 83 also turn upward in the direction D1 about the support shafts 85 (see FIG. 10). Hence, the support plate 65 is elastically lifted by the arm bent portions 83*b* of the lifting/lowering drive members 83 turning upward in the direction D1 with the aid of the coil springs 84. Consequently, the support plate 65 is lifted in the lifting direction C1.

In this case, when no sheets 4 are stored in the sheet storing portion 60, the support plate 65 is lifted and eventually stops at such a position that the support surface 66 (actually, the braking member 69) thereof comes into contact with the feeding roller 70 (see FIG. 8). While the follower members 82 are in contact with the arc-shaped portions 81*b* of the cam members 81, the arm bent portions 83*b* of the lifting/lowering drive members 83 are held at the highest positions. Hence, the support plate 65 continues to be elastically lifted by the lifting/lowering drive members 83 with the aid of the coil springs 84. Therefore, the support surface 66 of the support plate 65 continues to be in contact with the feeding roller 70. In the such a state where the support plate 65 (on which the downstream-side part 4S of the stack of sheets 4 are placed) is kept lifted, the feeding roller 70 feeds each of the sheets 4.

After the completion of feeding of one sheet 4, the lifting/lowering mechanism 80 performs a lowering operation in which the support plate 65 supported at the guide holes 57 is lowered in the lowering direction C2 corresponding to the perpendicular direction C, thereby returning to the standby position (see FIG. 5).

In this operation, in the lifting/lowering mechanism 80, the cam members 81 continue to rotate in the direction of rotation B together with the rotating shaft 71, and the follower members 82 having been in contact with the arc-shaped portions 81*b* of the cam members 81 come into contact with the second curved portions 81*d* and turn downward in a direction D2 about the support shafts 85. Simultaneously, the lifting/lowering drive members 83 also turn downward in the direction D2 about the support shafts 85. Thus, the support plate 65 elastically hung with the coil springs 84 is gradually lowered in the lowering direction C2 by the arm bent portions 83*b* of the lifting/lowering drive members 83 turning downward in the direction D2. When the follower members 82 leave the second curved portions 81*d* of the cam members 81 and come to face the smallest radius portions 81*a*, the support plate 65 returns to the standby position.

Figure 11:
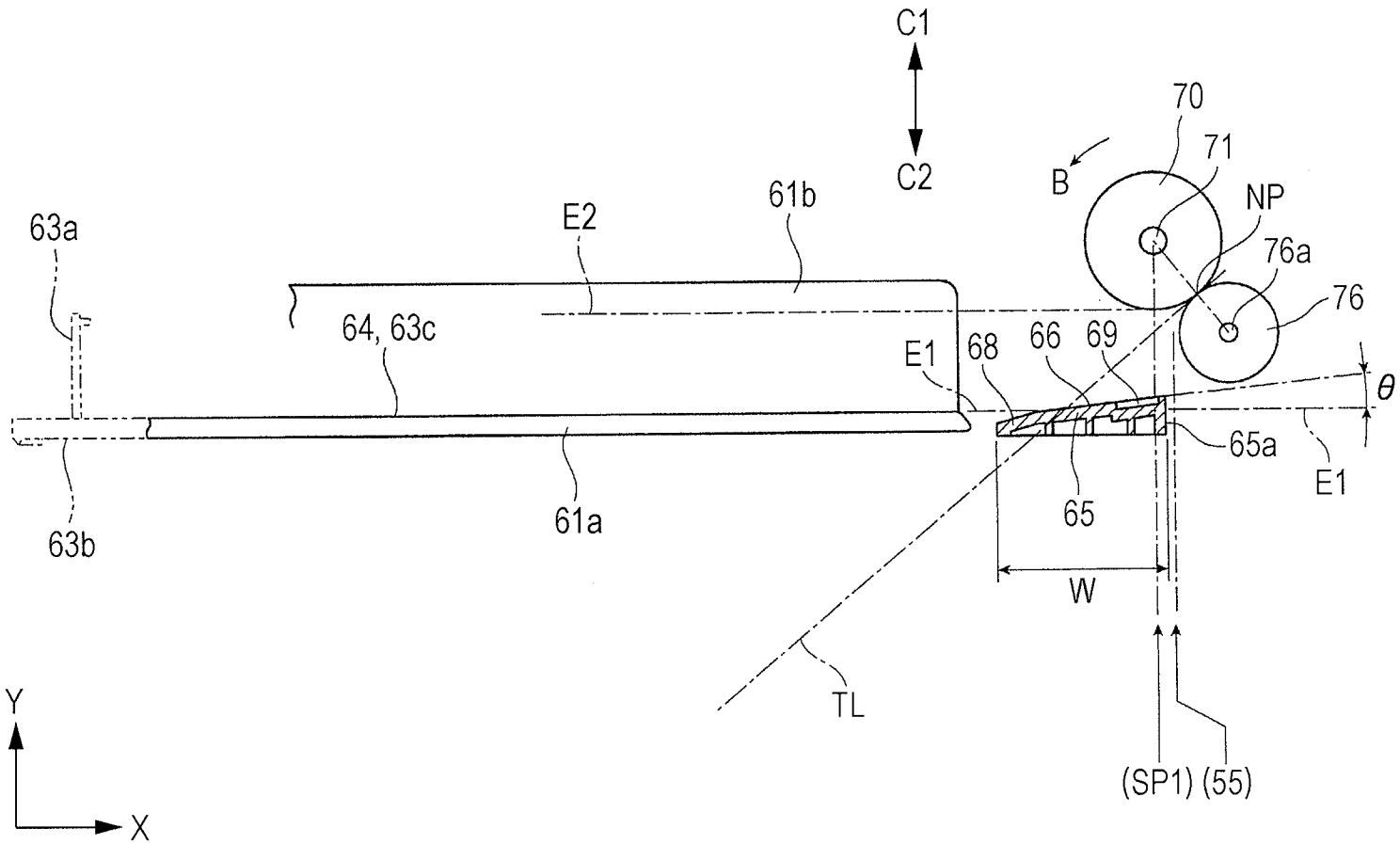
FIG. 11 illustrates the configuration of a support surface of the support plate.

In the sheet feeding device 5, as illustrated in FIGS. 4, 5, 11, and others, the support surface 66 of the support plate 65 forms a sloping surface angled with respect to the stacking surfaces 64 of the base portions 61*a* and 62*a* of the side positioning members 61 and 62 in such a manner as to become higher toward the downstream side in the sheet feeding direction A. In FIG. 11 and others, reference numeral 55 with parentheses denotes the position of the positioning surface (the wall surface or the ribs 55*a*) of the leading-end-positioning plate 55, and reference character SP1 with parentheses denotes the point of contact between the support surface 66 and the feeding roller 70 (the lowest point of the feeding roller 70) when the support plate 65 is lifted.

The support surface 66 of the support plate 65 slopes at a sloping angle θ with respect to the stacking surfaces (an extension line E1 of the stacking surfaces 64). The angle θ is set arbitrarily in accordance with the kind of sheets 4 to be used, the size of the sheet feeding device 5, and so forth. In the first exemplary embodiment, the sloping angle θ is set to about 6 degrees. The sloping angle θ is preferably 3 degrees at smallest. If the sloping angle θ is smaller than 3 degrees (for example, about 1 or 2 degrees), the sloping angle θ may be absorbed into, i.e., cancelled out by, dimensional tolerances of parts, errors in assembly, and the like. Meanwhile, the sloping angle θ is preferably smaller than an angle α (see FIG. 17) formed between a tangent line (TL) to both of the feeding roller 70 and the stopper roller 76 and the stacking surfaces 64. A dash-dotted line E2 illustrated in FIG. 11 and others is parallel to the extension line E1 of the stacking surfaces 64.

From viewpoints such as preventing the downstream-side part 4S of the stack of sheets 4 supported on the support surface 66 from slipping down when the support plate 65 is lifted, the support plate 65 has a width W in the sheet feeding direction A in its entirety (see FIG. 11). In the first exemplary embodiment, the feeding roller 70 has a diameter of about 25 mm. Relative to this, the width W of the support plate 65 is set to about 35 mm.

Part (upper corner) of the upstream-side end, in the sheet feeding direction A, of the support plate 65 is chamfered in such a manner as to reside below the stacking surfaces 64 and forms a chamfered sloping portion 68. The chamfered sloping portion 68 forms a sloping surface angled with respect to the stacking surfaces 64 at, for example, 30 to 45 degrees.

When no sheets 4 are stored in the sheet storing portion 60, the support plate 65 is positioned such that, as illustrated in FIGS. 5, 11, and others, the extension line E1 of the stacking surfaces 64 intersects the support plate 65 at a position above a lowest point 66*b* of the support surface 66 forming the above-described sloping surface. In this state, the support plate 65 is at the standby position. In FIG. 5 and others, reference numeral 66*a* denotes the highest point of the support surface 66.

The operation and so forth of the sheet feeding device 5 will now be described.

Figure 12:
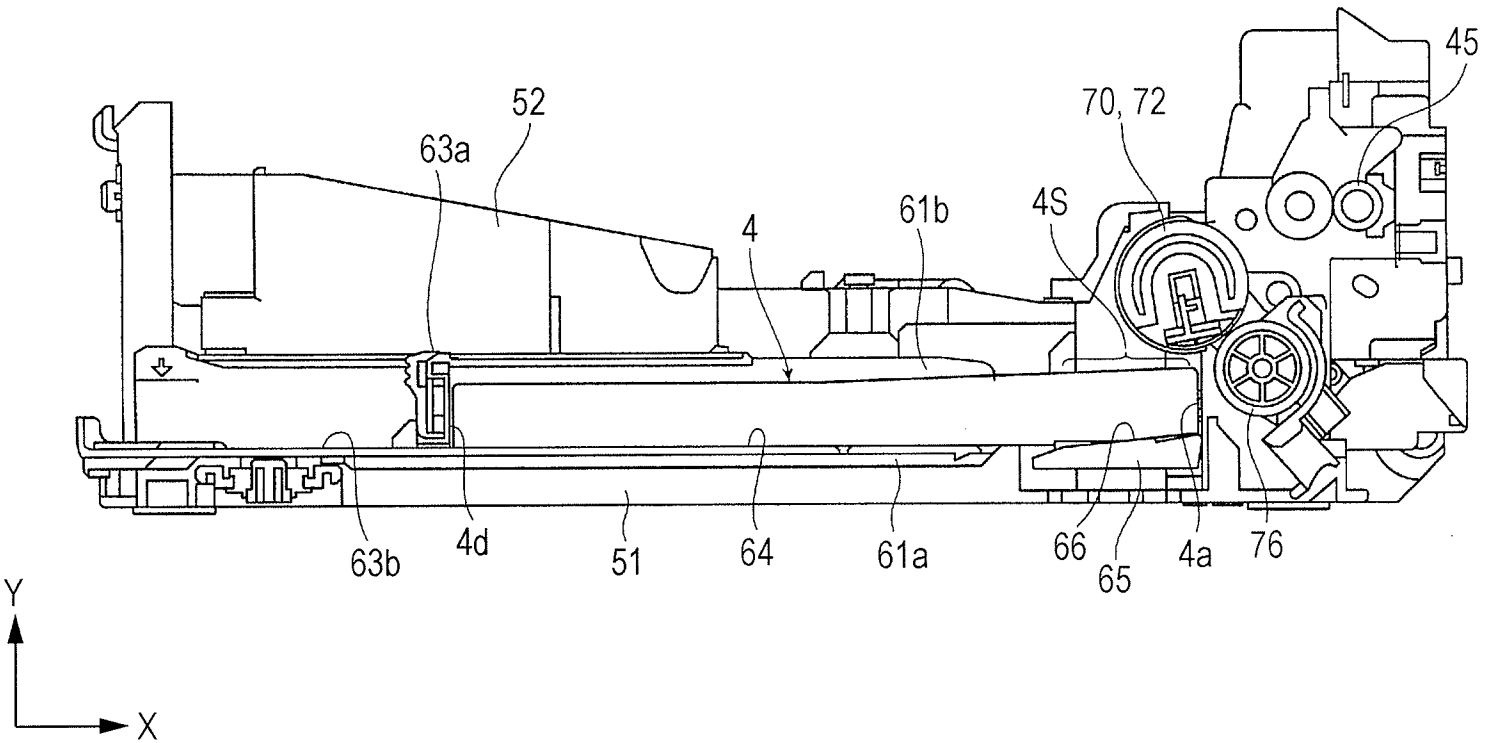
FIG. 12 is a sectional view of the sheet feeding device with sheets stored therein.

Referring to FIGS. 1, 12, and others, plural sheets 4 to be fed are first stored in the sheet storing portion 60 of the sheet feeding device 5. In storing the sheets 4, after the sheets 4 are placed over the stacking surfaces 64 of the side positioning members 61 and 62 (in the first and second exemplary embodiment, inclusive of the top edge 63*c* of the guiding track portion 63*b* of the trailing-end-positioning member 63) in the sheet storing portion 60, the side positioning members 61 and 62 are moved up to the positions of contact with the left and right sides 4*b* and 4*c*, respectively, of the sheets 4 and the positioning surface portion 63*a* of the trailing-end-positioning member 63 is moved up to the position of contact with the trailing ends 4*d* of the sheets 4.

Thus, as illustrated in FIG. 12 and others, the sheets 4 are properly stored at a predetermined position in the sheet storing portion 60. The leading ends 4*a* of the sheets 4 in this state are positioned in such a manner as to be in contact with the wall surface of the leading-end-positioning plate 55 (in a state where the leading ends 4*a* of the plural sheets 4 are aligned with one another) by the user's manual pushing of the sheets 4 toward the rear or moving of the positioning surface portion 63*a* of the trailing-end-positioning member 63. In this operation, after the leading end 4*a* of the bottommost one of the sheets 4 advancing along the stacking surfaces 64 reaches the support plate 65, the leading end 4*a* of the bottommost sheet 4 is guided along the support surface 66, as a sloping surface, of the support plate 65 and further advances smoothly to the wall surface of the leading-end-positioning plate 55. Thus, the sheets 4 as a stack are stored with the downstream-side part 4S thereof in the sheet feeding direction A being supported by the support surface 66 of the support plate 65.

In the state where the downstream-side part 4S of the stack of sheets 4 is supported by the support surface 66 of the support plate 65, the stack of sheets 4 extends over and in contact with the stacking surfaces 64 of the side positioning members 61 and 62 and the highest point 66*a* (top) of the support surface 66, as a sloping surface, of the support plate 65. In this state, the support plate 65 stays still at the standby position or at a position slightly lower than the standby position by being depressed in the lowering direction C2 corresponding to the perpendicular direction C. The support plate 65 stays at a position slightly lower than the standby position when, for example, the downstream-side part 4S of the stack of sheets 4 on the support surface 66 of the support plate 65 weighs over the tensile forces of the coil springs as the transmitting members 84 of the lifting/lowering mechanism 80. In that case, the support plate 65 is lowered from the lowest points 57*c* of the guide holes 57 in the lowering direction C2 corresponding to the perpendicular direction C within a range of the distance S (see FIG. 7) in proportion to the total weight of the downstream-side part 4S of the stack of sheets 4, and stops at a certain position. In such a case, the downstream-side part 4S of the stack of sheets 4 tends to be supported in such a manner as not to fully conform to the sloping surface formed by the support surface 66 of the support plate 65. When, for example, a small number of sheets 4 having relatively low strength are stored, the downstream-side part 4S of such a stack of sheets 4 may be fully conform to the sloping surface formed by the support surface 66 of the support plate 65.

When the sheets 4 each start to be fed, the rotating shaft 71, which is configured to be driven intermittently, starts to rotate. In response to this, the support plate 65 starts to be lifted in the lifting direction C1 corresponding to the perpendicular direction C by the lifting operation of the lifting/lowering mechanism 80, as described above. Simultaneously, the feeding roller 70 (actually, the semilunar roller 72) starts to rotate in the direction of rotation B for sheet feeding.

Figure 13:
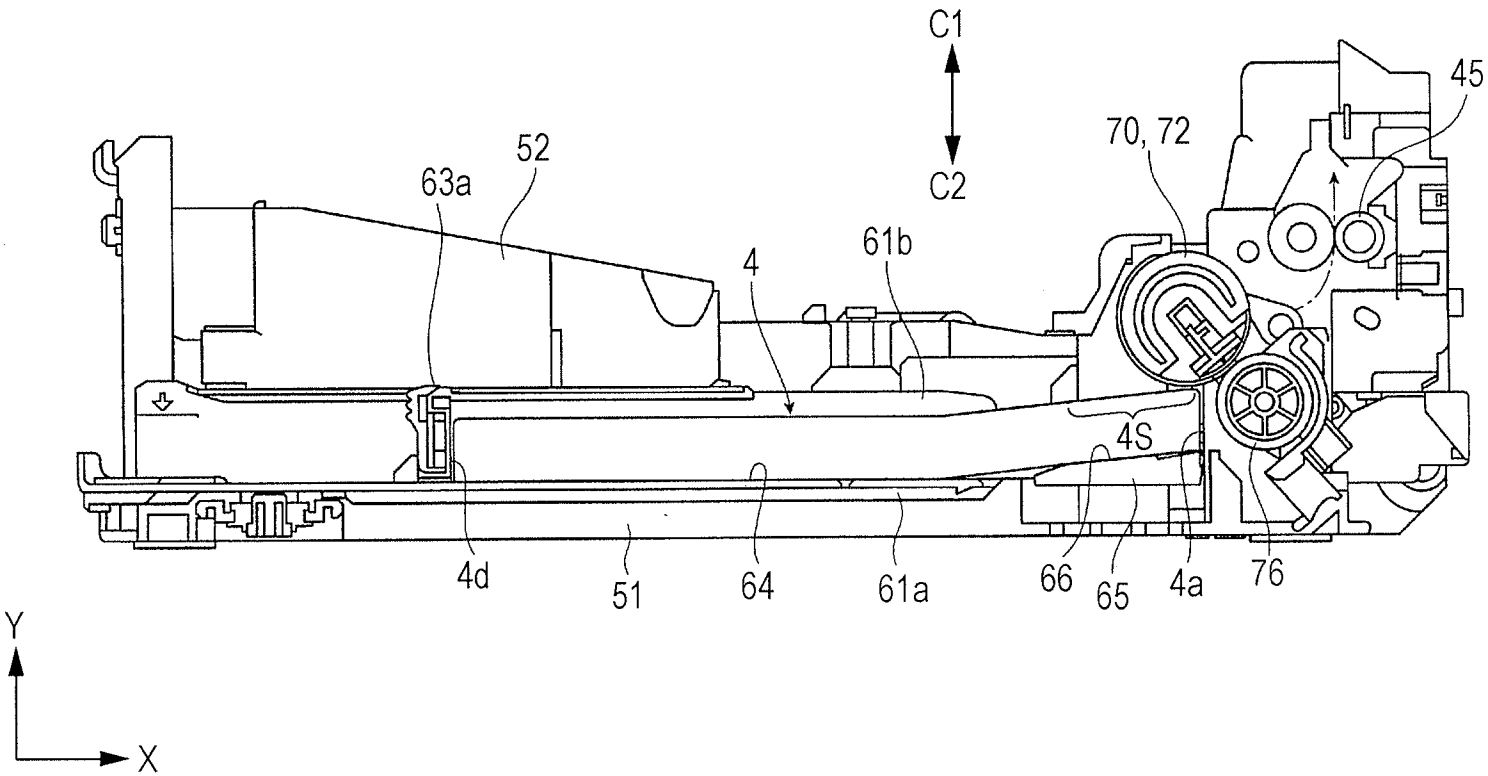
FIG. 13 is a sectional view of the sheet feeding device that is about to feed a sheet.
Figure 14:
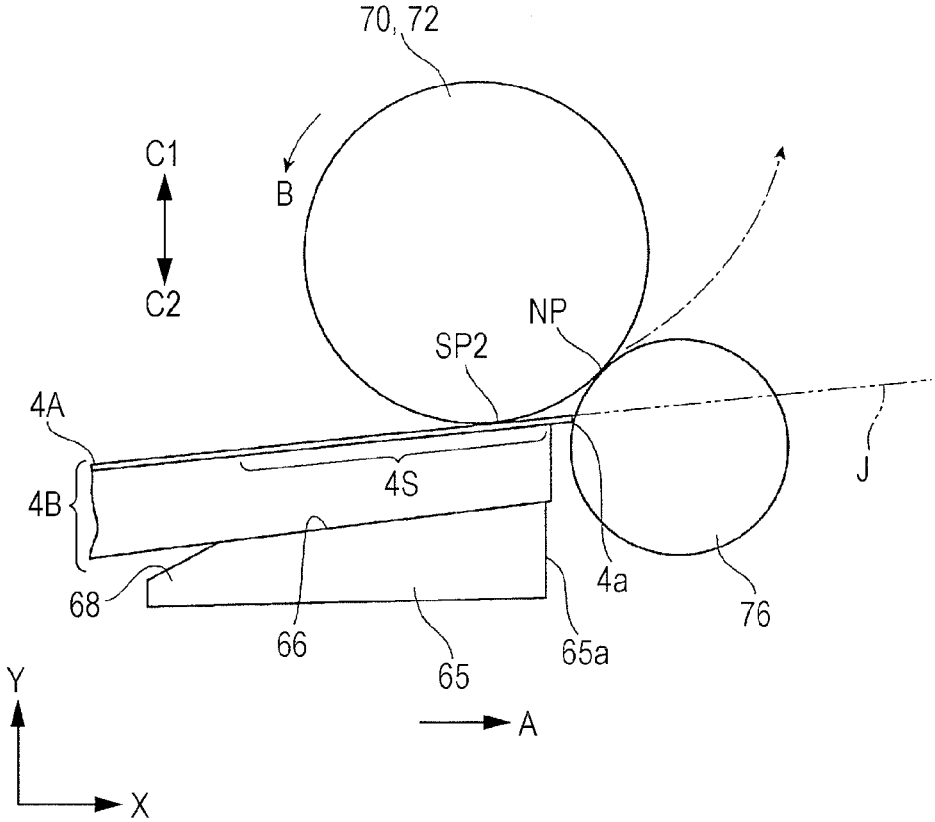
FIG. 14 illustrates a sheet feeding operation performed by the sheet feeding device.

In this operation, the downstream-side part 4S of the stack of sheets 4 supported by the support surface 66 of the support plate 65 that is being lifted is lifted as illustrated in FIGS. 13, 14, and others, and the downstream-side part 4S of the topmost sheet 4A is pressed into contact with the feeding roller 70. In this operation, in the lifting/lowering mechanism 80, while the lifting/lowering drive members 83 move to the highest positions and thus lift the support plate 65 as described above (see FIG. 10), the lifting of the support plate 65 is stopped when the downstream-side part 4S of the topmost sheet 4A of the stack of sheets 4 on the support surface 66 comes into contact with the feeding roller 70. In this state, since the tensile forces of the coil springs 84 continue to be applied to the support plate 65, the downstream-side part 4S of the stack of sheets 4 on the support surface 66 continue to be elastically pressed against the feeding roller 70. Furthermore, the leading ends 4*a* of the sheets 4 lifted by the support plate 65 is retained to be substantially aligned with the leading-end-positioning plate 55 without slipping down, because the trailing ends 4*d* of the sheets 4 are positioned by the trailing-end-positioning member 63.

In the above state, as illustrated in FIG. 14 and others, the downstream-side part 4S of the stack of sheets 4 conforming to the sloping surface formed by the support surface 66 of the support plate 65 slopes such that the downstream side thereof in the sheet feeding direction A resides higher than the other side thereof and is thus in contact with the feeding roller 70. In FIG. 14, reference character SP2 denotes the point of contact between the downstream-side part 4S of the topmost sheet 4A and the feeding roller 70.

Subsequently, the semilunar roller 72 of the feeding roller 70 that is in contact with the downstream-side part 4S of the topmost sheet 4A rotates, whereby the topmost sheet 4A is fed.

Thus, the leading end 4*a* of the topmost sheet 4A temporarily comes into contact with the stopper roller 76, is slightly deformed upward, advances into the nip NP between the feeding roller 70 and the stopper roller 76, and goes out of the sheet storing portion 60, as represented by the arrowed dash-dotted line, with a feeding effect exerted by the semilunar roller 72. If any sheets 4B other than the topmost sheet 4A are moved with the feeding effect exerted by the semilunar roller 72, such sheets 4B other than the topmost sheet 4A are stopped with the leading ends 4*a* thereof coming into contact with the stopper roller 76 without being affected by the feeding effect, thereby being prevented from being fed. Thus, the sheets 4 are fed one by one from the topmost sheet 4A. Each sheet 4 having been fed by the feeding roller 70 is guided to the pairs of transport rollers 45 by the sheet transport guide member 46.

After the completion of feeding of the topmost sheet 4A, the lifting/lowering mechanism 80 performs the lowering operation as described above, whereby the support plate 65 is lowered in the lowering direction C2 and returns to the standby position or the like. Thus, the downstream-side part 4S of the stack of sheets 4 on the support surface 66 of the support plate 65 is lowered and is moved away from the feeding roller 70.

Through the above series of operations, one sheet 4 is fed. To sequentially feed plural sheets 4, the above series of operations is repeated.

In the sheet feeding device 5, as illustrated in FIG. 14 and others, the downstream-side part 4S of the stack of sheets 4 lifted by the support plate 65 is retained to be angled in such a manner as to substantially conform to the sloping surface formed by the support surface 66 as described above. Therefore, even if the leading end 4*a* of the topmost sheet 4A fed by the feeding roller 70 temporarily comes into contact with the stopper roller 76, the topmost sheet 4A later easily advances into the nip NP between the feeding roller 70 and the stopper roller 76 in a good manner. Consequently, the topmost sheet 4A is fed in a good manner without being jammed before reaching the nip NP. In FIG. 14 and others, reference character J denotes the extension line of the topmost sheet 4A or the sloping surface formed by the support surface 66 of the support plate 65.

Figure 15:
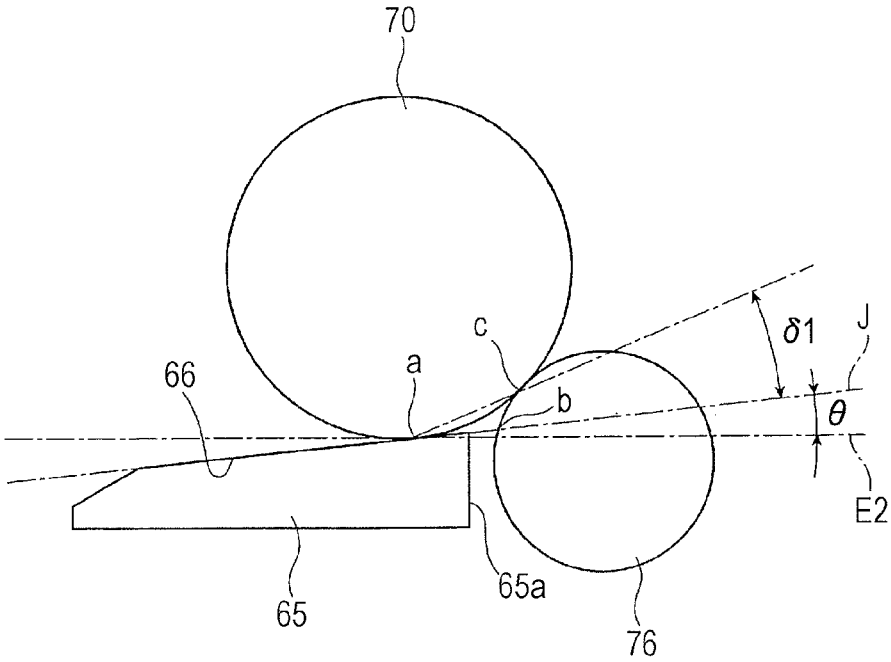
FIG. 15 illustrates a function of the support surface of the support plate that forms a sloping surface.

Referring to FIG. 15, in the sheet feeding device 5, let the point of contact between the support plate 65 and the feeding roller 70 be a contact point a, the point at which the leading end 4*a* of a sheet 4 fed from the support surface 66 of the support plate 65 comes into contact with the stopper roller 76 be a contact point b, and the point of contact between the feeding roller 70 and the stopper roller 76 be a contact point c. Here, a line passing through the contact points a and b and a line passing through the contact points a and c intersect each other at the contact point a. Furthermore, the two lines form a relatively small angle 61 (an approach angle of the leading end 4*a* of the sheet 4 into the nip NP between the feeding roller 70 and the stopper roller 76).

Figure 16:
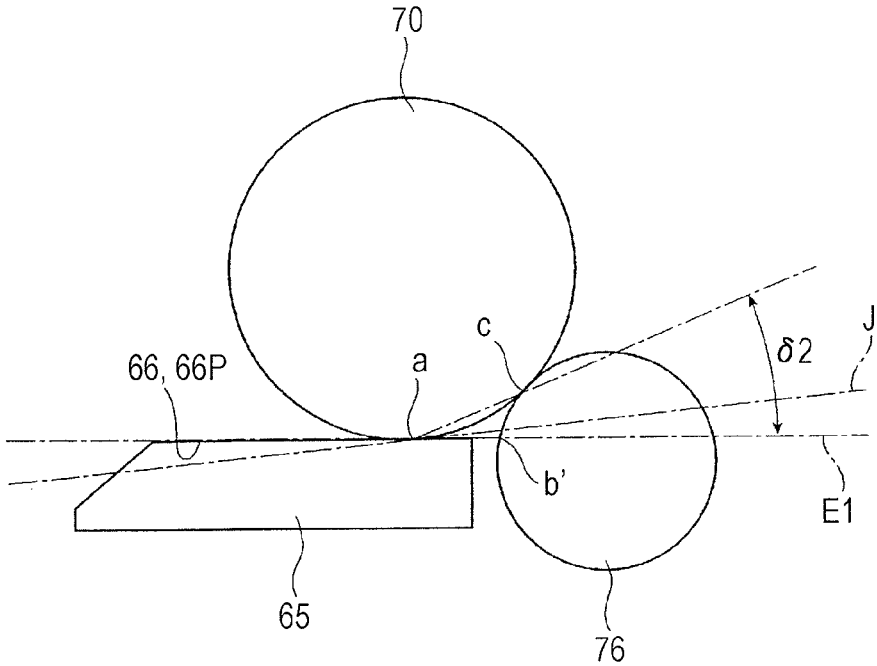
FIG. 16 RELATED ART
FIG. 16 illustrates a problem arising in a case where a support plate whose support surface does not form a sloping surface is employed.

In contrast, in a case illustrated in FIG. 16 where a support plate 65 having a support surface 66 forming a non-sloping surface 66P that is substantially parallel to the stacking surfaces 64 is employed, the line passing through the contact points a and b (b' in FIG. 16) and the line passing through the contact points a and c form a relatively large angle $\delta 2$ ($\delta 2 > \delta 1$). Particularly, if a sheet 4 having high strength (weighing 216 g/m$^2$ or greater, for example), such as a postcard or a cardboard, is fed at the larger angle $\delta 2$, the leading end 4*a* of the sheet 4 advancing along the non-sloping surface 66P toward the stopper roller 76 and coming into contact therewith is difficult to be deformed toward the nip NP between the feeding roller 70 and the stopper roller 76 even with the feeding effect exerted by the feeding roller 70. Consequently, the sheet 4 may be jammed (may not be fed from the nip NP) with the leading end 4*a* thereof prevented from reaching the nip NP.

In this respect, in the sheet feeding device 5 according to the first exemplary embodiment employing the support plate 65 having the support surface 66 forming the above-described sloping surface, even a sheet 4 having high strength is fed in a good manner without being jammed.

Figure 17:
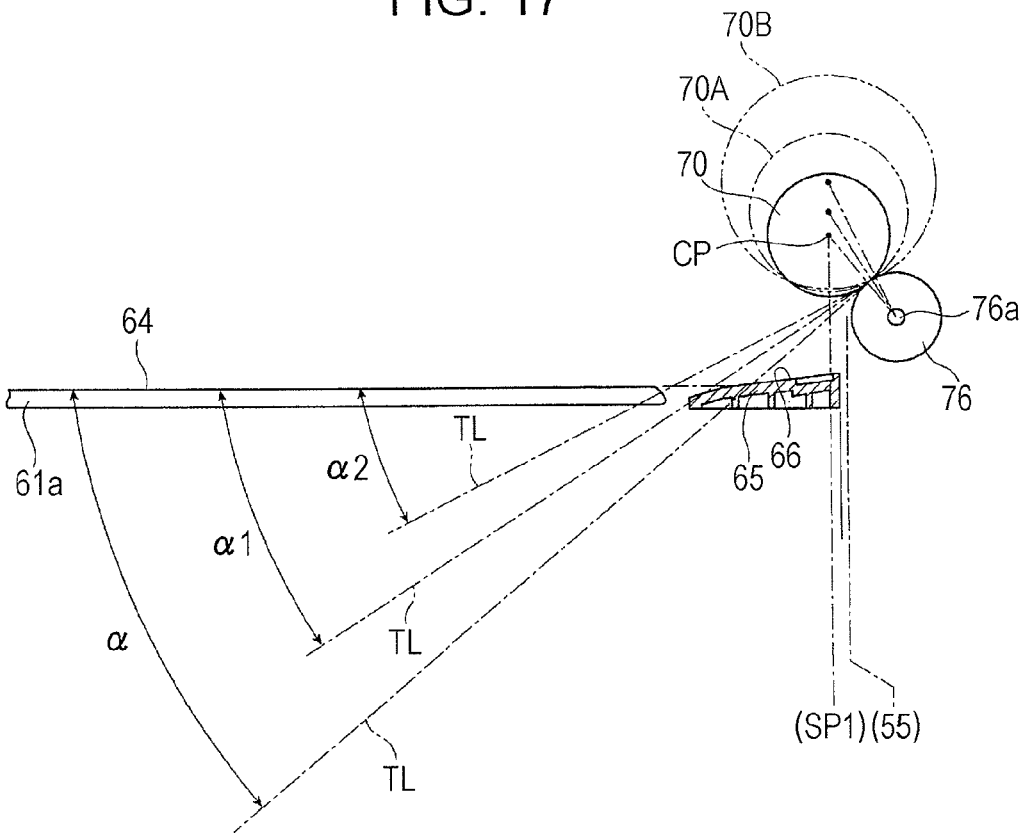
FIG. 17 illustrates the difficulty in feeding a sheet in a case where a feeding roller having a relatively small diameter is employed.

In the sheet feeding device 5 according to the first exemplary embodiment, the feeding roller 70 has a relatively small diameter of 25 mm, as described above, from the viewpoints of reduction in the device size and so forth. Therefore, as illustrated in FIG. 17, the angle $\alpha$ of the tangent line TL passing through the nip NP between the feeding roller 70 and the stopper roller 76 with respect to the stacking surfaces 64 is larger than angles $\alpha 1$ and $\alpha 2$ in respective comparative cases of feeding rollers 70A and 70B having larger diameters than the feeding roller 70 ($\alpha > \alpha 1 > \alpha 2$). Accordingly, the angle formed between the tangent line TL and the downstream-side part 4S of the stack of sheets 4 supported and lifted by the support plate 65 is also larger than those in the comparative cases. To cause the leading end 4*a* of each sheet 4 to advance toward the nip NP between the feeding roller 70 and the stopper roller 76, the leading end 4*a* of the sheet 4 is desired to advance toward the nip NP while being deformed by a larger amount. In FIG. 17, it is supposed that the feeding rollers 70A and 70B having larger diameters are each in contact with the stopper roller 76, whose position is fixed, with axial centers CP thereof residing on a virtual line that passes through an axial center CP of the feeding roller 70 and extends in the vertical direction Y.

Considering the way the angle $\alpha$ increases, as the number of sheets 4 stored becomes relatively larger or the strength of the sheets 4 becomes relatively higher, the probability that each of such sheets 4 may not be fed in a good manner becomes higher. For example, in a case where a large number of sheets 4 are stored, the height of the trailing end 4*d* of the topmost sheet 4A from the stacking surfaces 64 is higher than that in a case where a small number of sheets 4 are stored. If the height of the trailing end 4*d* of the topmost sheet 4A exceeds a specific level, the angle at which each sheet 4 is fed (the angle $\alpha$ formed between the stacking surfaces 64 and a line connecting the trailing end 4*d* of the topmost sheet 4A and the point of contact between the feeding roller 70 and the topmost sheet 4A) becomes smaller than the sloping angle $\theta$ of the support surface 66 of the support plate 65 ($\alpha < \theta$). Even in such a case, if the sheets 4 have relatively low strength, the downstream-side part 4S of the stack of sheets 4 is supported while being deformed in such a manner as to fully conform to the sloping surface formed by the support surface 66 of the support plate 65 and the angle α at which each of the sheets 4 is fed is retained to be substantially equal to the sloping angle θ of the support surface 66 of the support plate 65, whereby the sheet 4 is fed in a good manner. However, as the strength of the sheets 4 becomes higher, it becomes more difficult to cause the downstream-side part 4S of the stack of sheets 4 to be deformed (bent) in such a manner as to fully conform to the sloping surface formed by the support surface 66 of the support plate 65, that is, a gap is produced between the support surface 66 of the support plate 65 and the downstream-side part 4S of the stack of sheets 4. Consequently, with such sheets 4 having high strength, it is difficult to produce the effect of realizing a good feeding operation by supporting the stack of sheets 4 with the downstream-side part 4S thereof conforming to the sloping surface formed by the support surface 66 of the support plate 65. Therefore, the leading end 4*a* of each of the sheets 4 may not be sufficiently deformed toward the nip NP after coming into contact with the stopper roller 76 and may be jammed.

In this respect, in the case of the support plate 65 having the support surface 66 forming the above-described sloping surface, the angle formed between the tangent line TL and the downstream-side part 4S of the stack of sheets 4 supported and lifted by the support surface 66 is smaller by an amount corresponding to the angle of slope of the support surface 66. Consequently, even if the feeding roller 70 has a relatively small diameter or even if the number of sheets 4 stored is small or the sheets 4 have high strength, each of such sheets 4 is fed in a good manner.

Considering from another viewpoint, referring to FIG. 17, in the case where a roller having a relatively large diameter (for example, the feeding roller 70A or 70B) is employed as the feeding roller 70, the angle α formed between the tangent line TL and the stacking surfaces 64 or the support surface 66 may be reduced (for example, reduced to α2) even if the support surface 66 of the support plate 65 does not form a sloping surface. Nevertheless, since a space sufficient for accommodating the feeding roller 70A or 70B having a large diameter needs to be provided, it is difficult to reduce the size of the sheet feeding device 5. In contrast, the sheet feeding device 5 according to the first exemplary embodiment employs the support plate 65 having the support surface 66 forming the above-described sloping surface. Therefore, even if the feeding roller 70 has a relatively small diameter, an effect (a reduction in the angle α) similar to that produced in the case of the feeding roller 70A or 70B having a large diameter is produced and, moreover, the size of the device is reduced.

In the image forming apparatus 1 employing the sheet feeding device 5 according to the first exemplary embodiment, each of the sheets 4 is fed to the second transfer position in a good manner by the sheet feeding device 5 without being jammed, regardless of the kind (for example, strength, thickness, and so forth) of the sheets 4 and the number of sheets 4 stored. Therefore, stable image formation on each of the sheets 4 fed from the sheet feeding device 5 is realized.

Second Exemplary Embodiment

Figure 18:
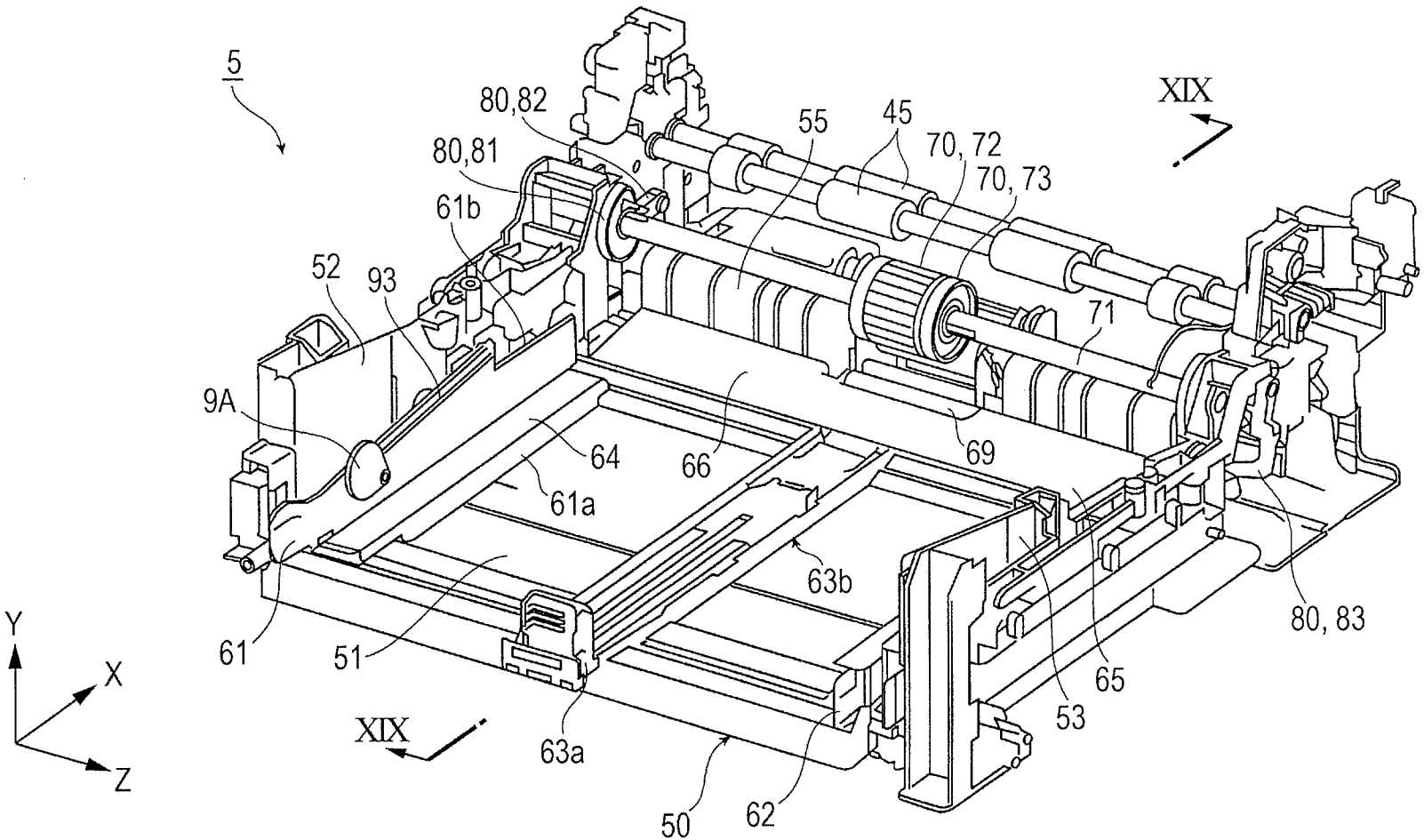
FIG. 18 is a perspective view of a sheet feeding device according to a second exemplary embodiment with a sheet transport guide member and other parts removed.
Figure 19:
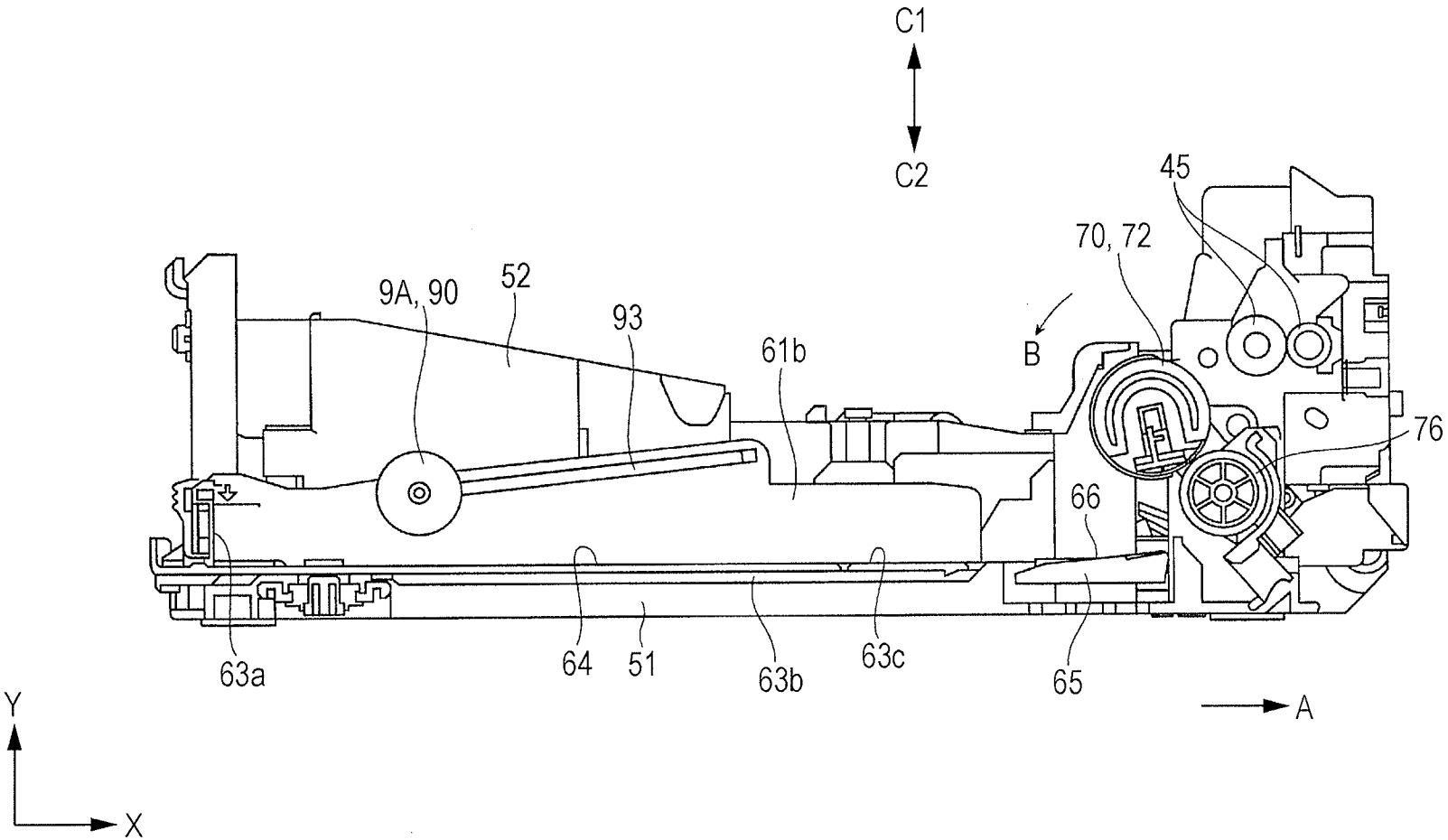
FIG. 19 is a sectional view of the sheet feeding device taken along line XIX-XIX illustrated in FIG. 18.
Figure 20:
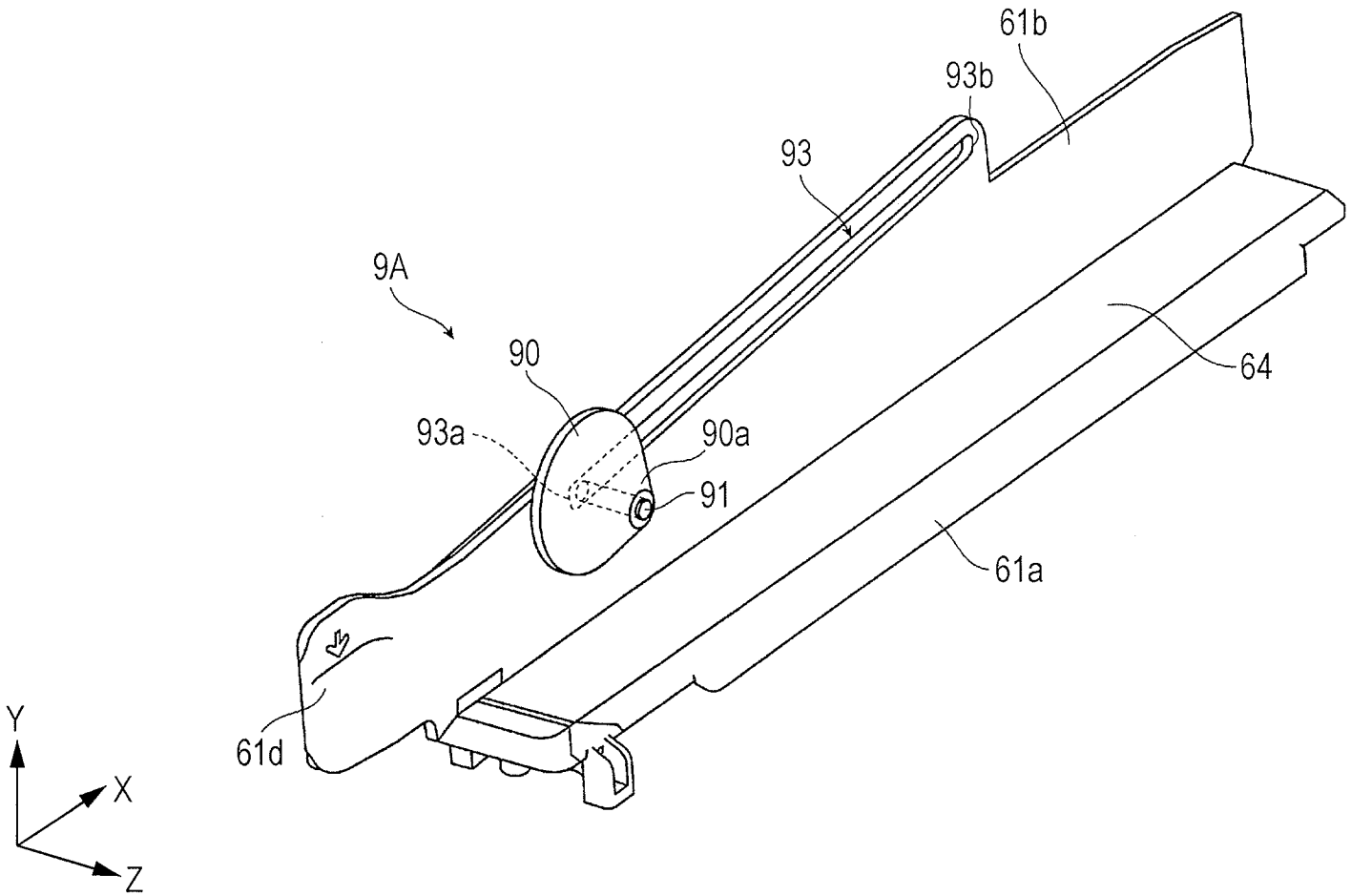
FIG. 20 is a perspective view of one of pressing members according to the second exemplary embodiment that is at the lowest position.

FIGS. 18 and 19 illustrate a sheet feeding device 5 according to a second exemplary embodiment. FIG. 18 illustrates the outline of the sheet feeding device 5 (with some parts such as the sheet transport guide member 46 removed). FIG. 19 is a sectional view of the sheet feeding device 5 taken along line XIX-XIX illustrated in FIG. 18.

The sheet feeding device 5 according to the second exemplary embodiment has the same configuration as the sheet feeding device 5 according to the first exemplary embodiment (see FIG. 2 and others) except that a pressing member 9 (9A, 9B, or 9C) is added. The pressing member 9 comes into contact with the topmost sheet 4A of the stack of sheets 4 stored in the sheet storing portion 60. When the support plate 65 is moved, the pressing member 9 acts in such a manner as to press the downstream-side part 4S of the stack of sheets 4 against the sloping surface formed by the support surface 66 of the support plate 65. In the second exemplary embodiment, the pressing member 9 is movably provided on the positioning surface portions 61*b* and 62*b* of the side positioning members 61 and 62 in the sheet storing portion 60.

The pressing member 9 is provided for the following reason.

Figure 27:
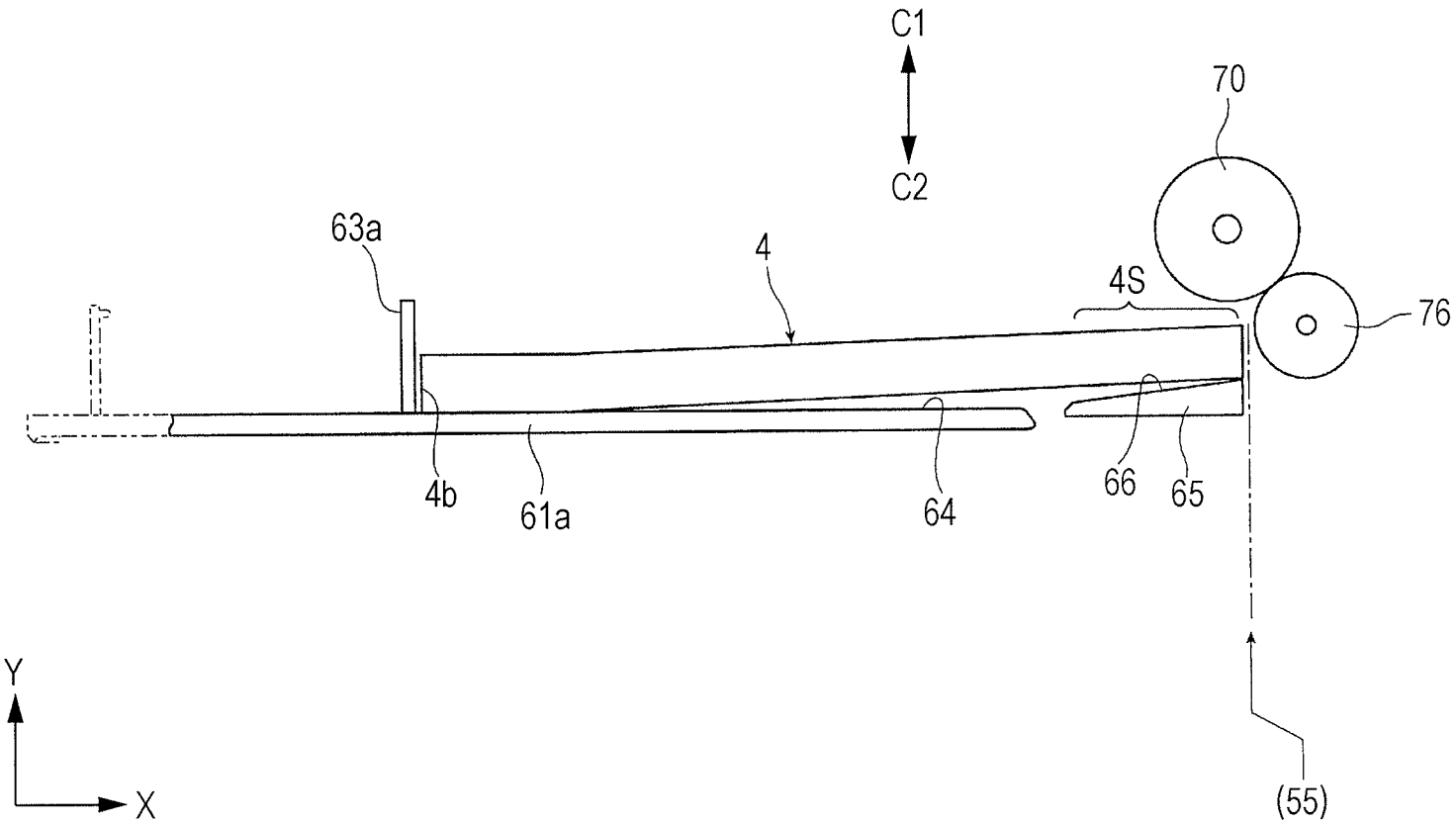
FIG. 27 illustrates a problem arising in a sheet feeding device including no pressing members and in a case where sheets stored therein have high strength.

In a case where the sheets 4 have relatively high strength, when a relatively large number of sheets 4 are stored and the support plate 65 is moved in the lifting direction C1 perpendicular to the stacking surfaces 64 at the time of sheet feeding as illustrated in FIG. 27, the stack of sheets 4 is generally supported by the top of the downstream-side end 65*a*, in the sheet feeding direction A, of the support plate 65 and part of the stacking surfaces 64. Consequently, a lower region of the downstream-side part 4S of the stack of sheets 4 is out of contact with the sloping surface formed by the support surface 66 (with a gap produced therebetween), that is, the downstream-side part 4S is not entirely in contact with the sloping surface formed by the support surface 66, not conforming thereto (the sheets 4 do not bend). If sheet feeding is performed with the downstream-side part 4S of the stack of sheets 4 being partially out of contact with the support surface 66 of the support plate 65, the approach angle (δ illustrated in FIG. 15 and others) of the leading end 4*a* of the topmost sheet 4A into the nip NP between the feeding roller 70 and the stopper roller 76 becomes larger than that in the case where the downstream-side part 4S is not out of contact with the support surface 66, increasing the probability of jamming of the leading end 4*a* of the topmost sheet 4A before reaching the nip NP. Therefore, the pressing member 9 is provided so as to prevent the downstream-side part 4S of the stack of sheets 4 from being partially out of contact with the support surface 66 of the support plate 65 as described above.

Referring to FIGS. 19 to 23 and others, pressing members 9A according to the second exemplary embodiment each include a body member 90 having a substantially conical appearance and rotatably provided on a rotating shaft 91, the rotating shaft 91 extending along the center axis of the conical shape. Each pressing member 9A is provided on the inner side of a corresponding one of the positioning surface portions 61*b* and 62*b* of the side positioning members 61 and 62, with a vertex 90*a* of the body member 90 thereof facing an opposite one of the positioning surface portions 61*b* and 62*b* of the side positioning members 61 and 62. A portion of the rotating shaft 91 projecting from the base of the body member 90 is movably fitted in a guide hole 93 provided in a corresponding one of the positioning surface portions 61*b* and 62*b* of the side positioning members 61 and 62. (Hereinafter, reference numerals of the side positioning member 62 and other parts associated therewith are indicated with parentheses, according to need.)

Referring to FIGS. 20 to 23 and others, the guide hole 93 is an oblong hole extending linearly and at an angle, with respect to a corresponding one of the stacking surfaces 64, substantially equal to the sloping angle θ of the sloping surface formed by the support surface 66 of the support plate 65. The guide hole 93 is provided in a central portion of the positioning surface portion 61*b* (62*b*) of the side positioning member 61 (62) and at such a height from the stacking surface 64 that the pressing member 9A comes into contact at a part 90*c* of the cone surface thereof with the left side 4*b* (right side 4*c*) of the topmost sheet 4A. An end 93*a* of the guide hole 93 on the lower side (on the upstream side in the sheet feeding direction A) is set to such a height that, when the number of sheets 4 stored is smaller than a specific value, the pressing member 9A is not in contact with, i.e., out of contact with, the left side 4*b* (right side 4*c*) of the topmost sheet 4A.

Figure 21:
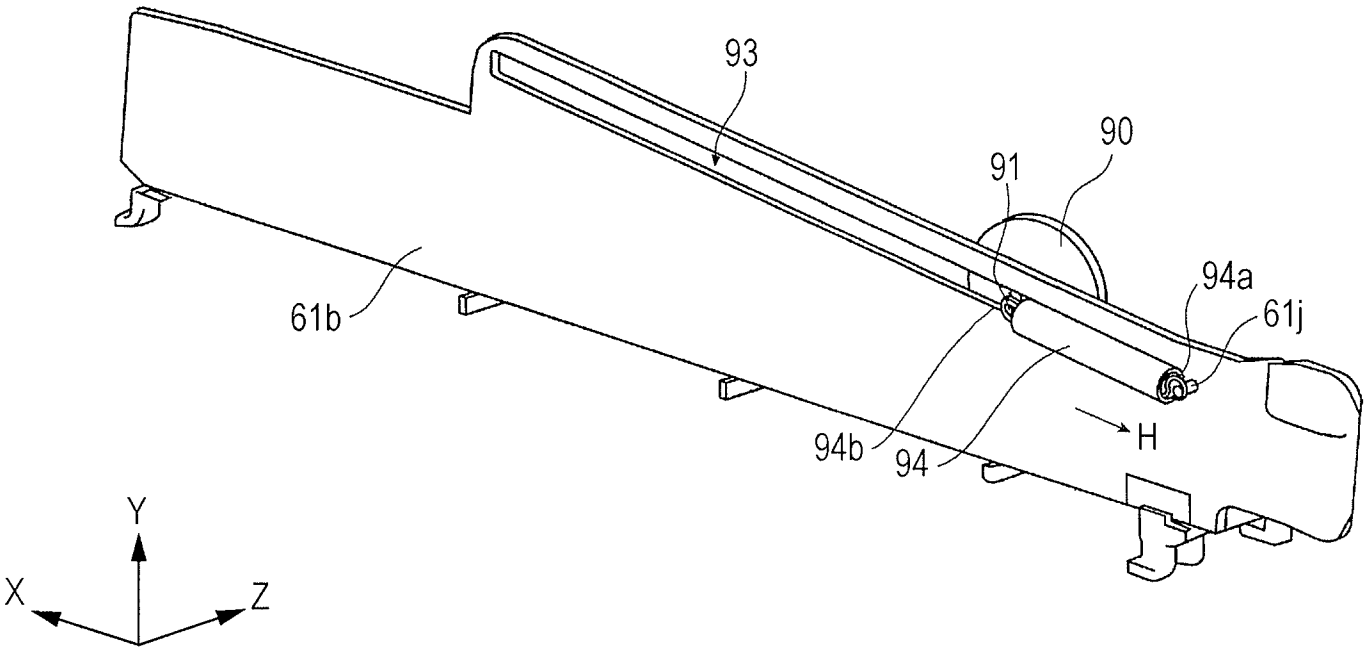
FIG. 21 is a rear perspective view of the pressing member illustrated in FIG. 20 seen from the outer side of a positioning surface portion.
Figure 22:
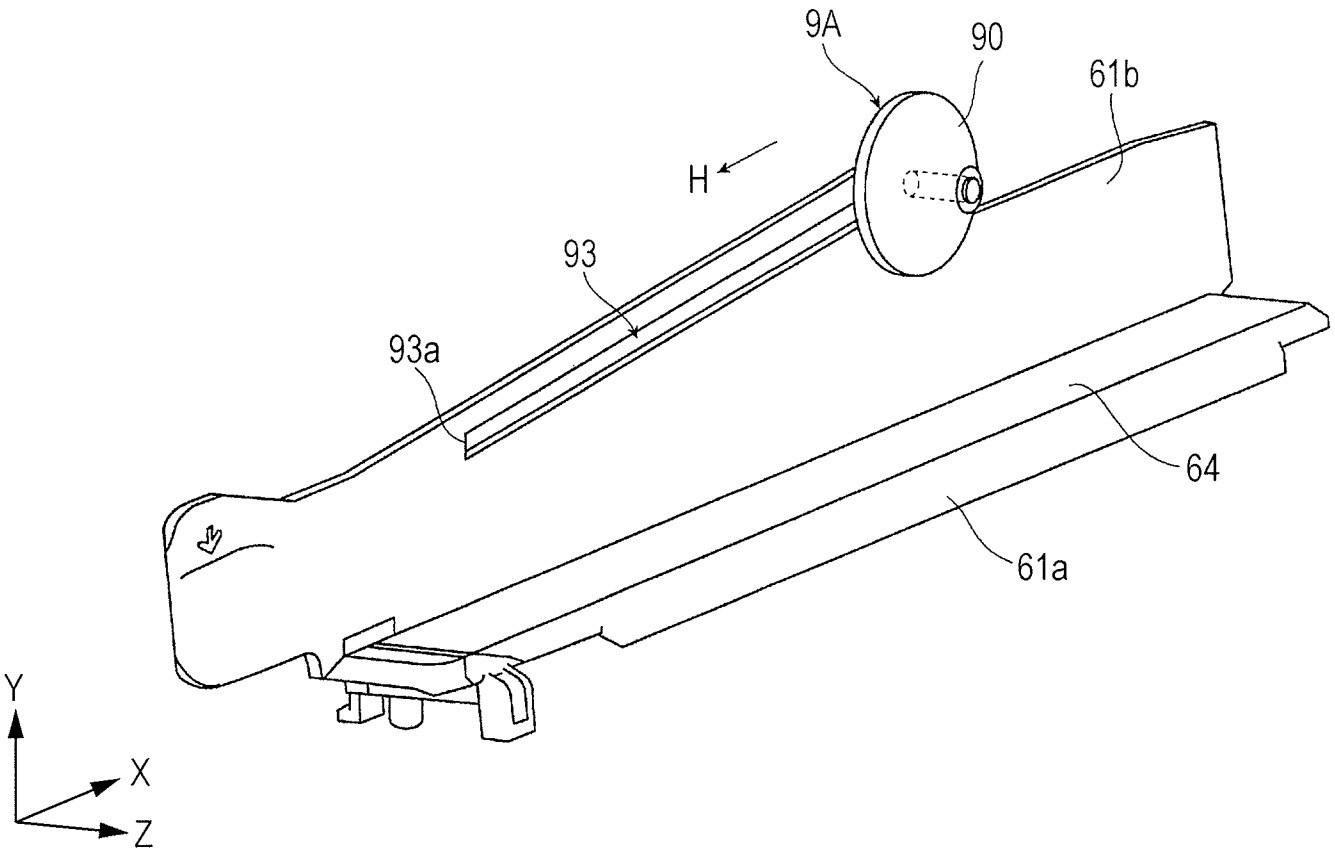
FIG. 22 is a perspective view of the pressing member illustrated in FIG. 20 that is at the highest position.
Figure 23:
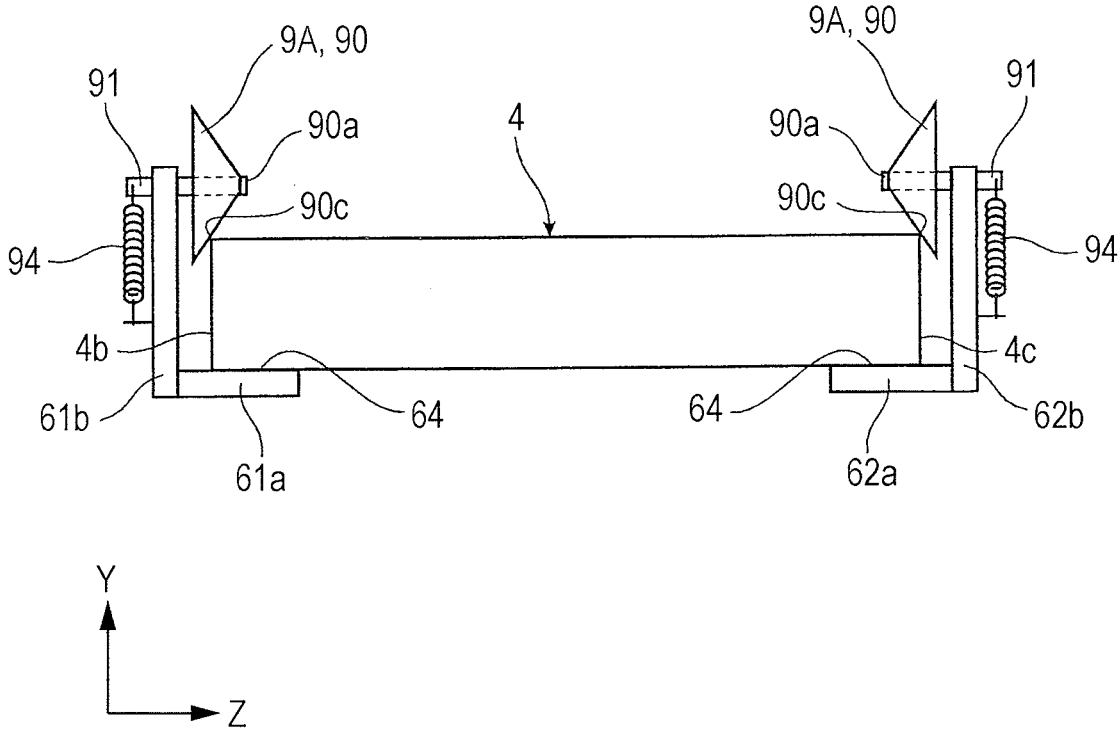
FIG. 23 illustrates a state where the pressing members according to the second exemplary embodiment are pressing a stack of sheets.

Referring to FIGS. 21, 23, and others, the pressing member 9A is retained to be pulled toward the lower-side end 93*a* of the guide hole 93 by a coil spring 94 exerting a tensile force H and being hooked on the rotating shaft 91. The coil spring 94 has one end 94*a* thereof attached to a projection 61*j* provided on the positioning surface portion 61*b* (62*b*) of the side positioning member 61 (62) and another end 94*b* thereof attached to the portion of the rotating shaft 91 projecting from the guide hole 93.

The sheet feeding device 5 including the pressing members 9A operates as follows.

Sheets 4 (having high strength) to be fed are stored in the sheet storing portion 60 in the same manner as in the first exemplary embodiment. In this storing step, the side positioning members 61 and 62 are moved up to positions of contact with the left and right sides 4*b* and 4*c*, respectively, of the sheets 4 placed over the stacking surfaces 64 of the side positioning members 61 and 62. In this step, the pressing members 9A eventually fall into such a state where the parts 90*c* of the cone surfaces of the body members 90 are in contact with the left and right sides 4*b* and 4*c*, respectively, of the topmost sheet 4A of the stack of sheets 4 stored (see FIG. 23). Furthermore, in conjunction with the operation in which the side positioning members 61 and 62 are moved in the horizontal direction Z up to the positions of contact with the left and right sides 4*b* and 4*c* of the sheets 4, the pressing members 9A receive at the parts 90*c* of the cone surfaces of the body members 90 thereof respective reaction forces from the left and right sides 4*b* and 4*c* of the topmost sheet 4A (external forces that cause the body members 90 to go over the left and right sides 4*b* and 4*c* of the topmost sheet 4A). Therefore, the body members 90 move toward higher-side ends 93*b* of the guide holes 93 by specific lengths, respectively, in accordance with the number of sheets 4 stored, against the tensile forces H exerted by the coil springs 94 (see FIG. 24).

Figure 24:
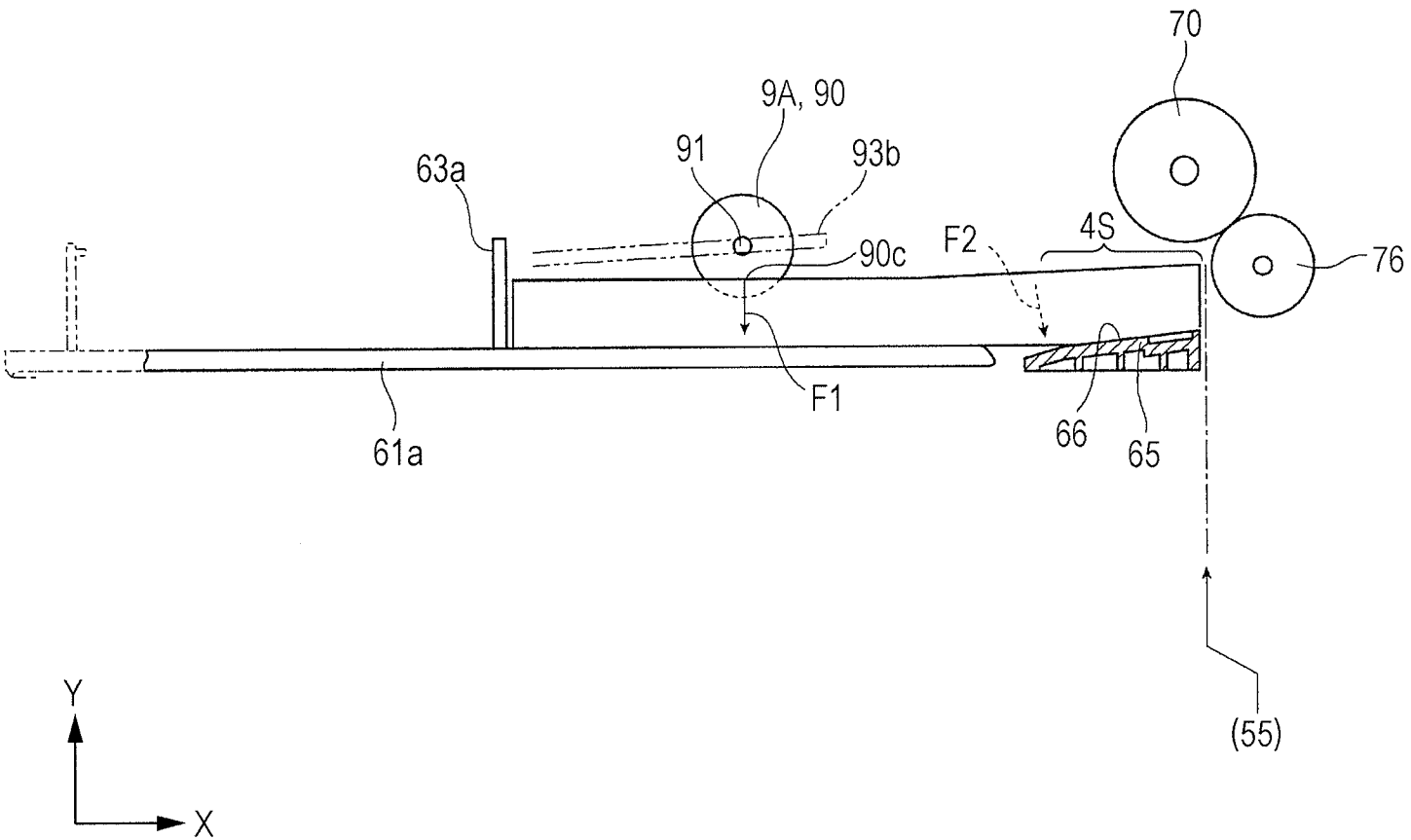
FIG. 24 illustrates the state where the pressing members illustrated in FIG. 23 are pressing the stack of sheets and an effect produced in this state.

Thus, referring to FIG. 24, the stack of sheets 4 stored in the sheet storing portion 60 receives a pressing force F1 acting downward from the pressing members 9A. Furthermore, a force F2 as part of the pressing force F1 exerted by the pressing members 9A acts on the downstream-side part 4S of the stack of sheets 4. Consequently, a lower region of the downstream-side part 4S of the sheets 4 is pressed against the sloping surface formed by the support surface 66 of the support plate 65.

Figure 25:
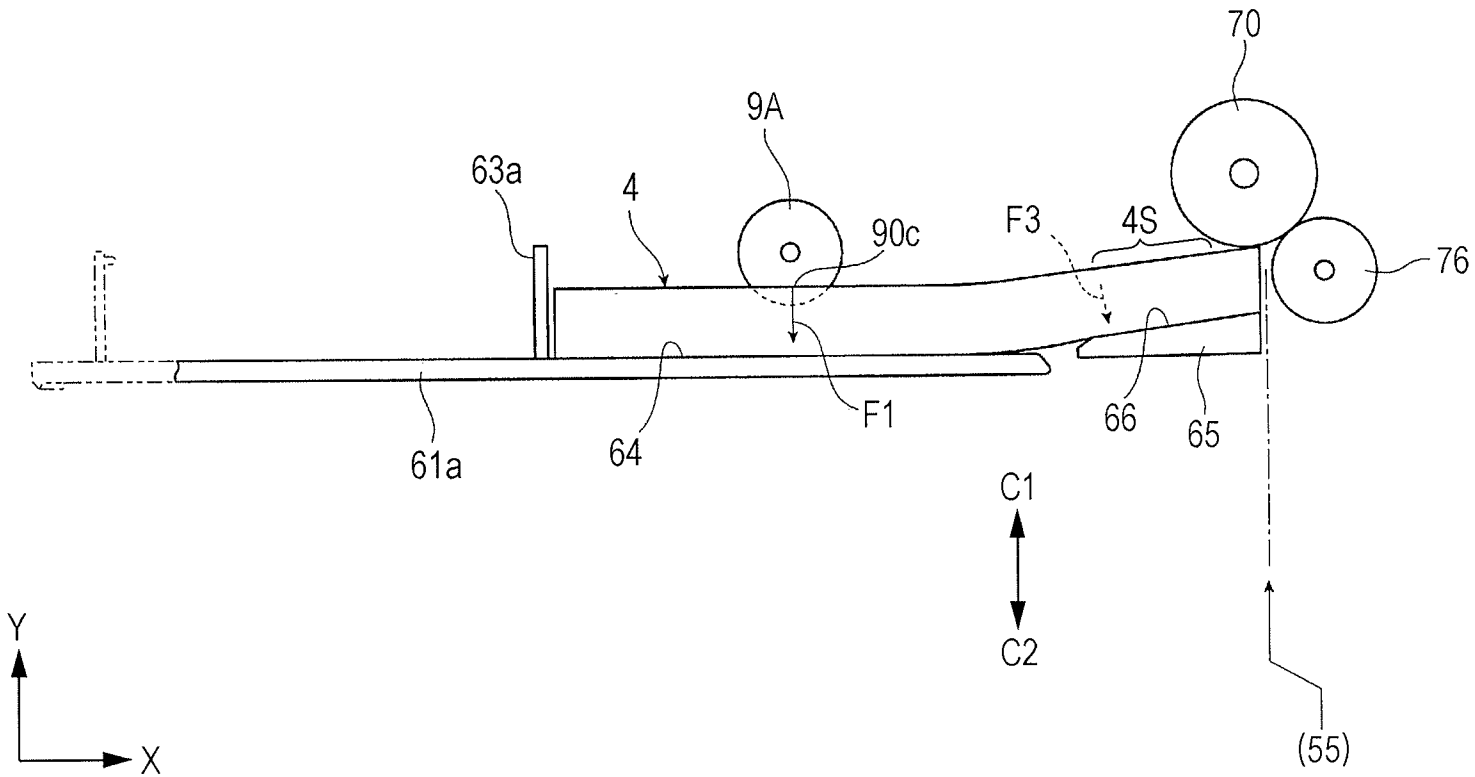
FIG. 25 illustrates a state where the pressing members illustrated in FIG. 23 are pressing the stack of sheets at the time of sheet feeding and an effect produced in this state.

Subsequently, referring to FIG. 25, at the time of sheet feeding, the support plate 65 is lifted in the lifting direction C1 corresponding to the perpendicular direction C. Therefore, the downstream-side part 4S of the stack of sheets 4 is lifted, and the topmost sheet 4A is thus pressed against the feeding roller 70.

In this state also, since the stack of sheets 4 receives the pressing force F1 from the pressing members 9A, a force F3 as part of the pressing force F1 acts on the downstream-side part 4S of the stack of sheets 4. The force F3 is a relatively large force (F3>F2) because the support plate 65 is lifted and the downstream-side part 4S of the stack of sheets 4 is raised to a level close to the pressing members 9A.

Therefore, a lower region of the downstream-side part 4S of the stack of sheets 4 is retained to be pressed against the sloping surface formed by the support surface 66 of the support plate 65 having been lifted. Consequently, even if the sheets 4 have high strength, the approach angle (δ) of the leading end 4*a* of the topmost sheet 4A into the nip NP between the feeding roller 70 and the stopper roller 76 becomes small. Thus, each of the sheets 4 is fed in a good manner without being jammed. When the sheet 4 is fed, the pressing members 9A may rotate following the movement of the topmost sheet 4A.

Figure 26:
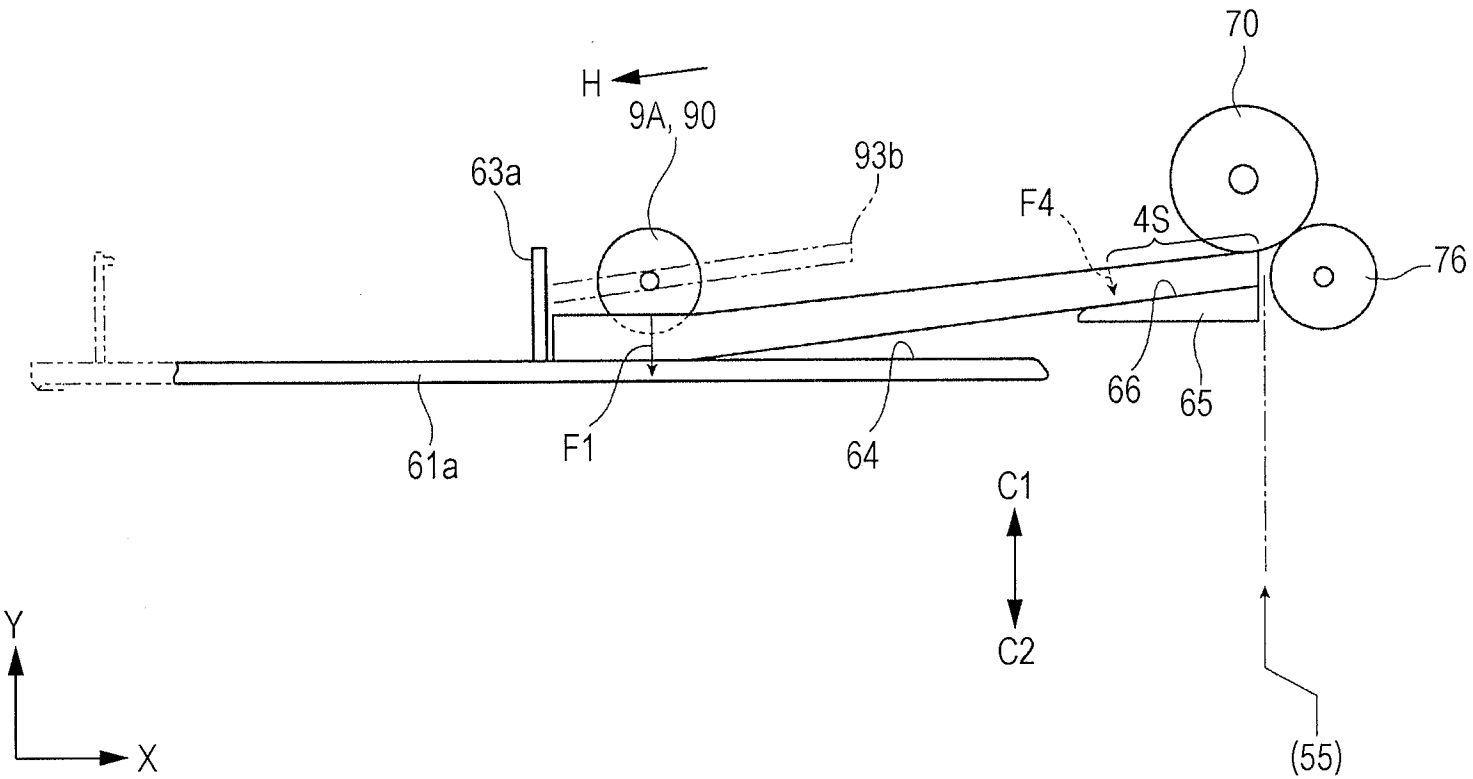
FIG. 26 illustrates a state where the pressing members illustrated in FIG. 23 are pressing the stack of sheets the number of which has been reduced during sheet feeding and an effect produced in this state.

As some sheets 4 are fed sequentially, referring to FIG. 26, the number of sheets 4 stored in the sheet storing portion 60 gradually decreases. Accordingly, the pressing members 9A gradually move toward the lower-side ends 93*a* of the respective guide holes 93 correspondingly to the decrease in the number of sheets 4 stored.

The stack of sheets 4 in this state receives the pressing force F1 from the pressing members 9A. Since the pressing members 9A gradually move away from the downstream-side part 4S of the stack of sheets 4, a force F4 as part of the pressing force F1 acting on the downstream-side part 4S of the stack of sheets 4 gradually becomes smaller (F4<F3). Thus, with the pressing members 9A, the magnitude of the pressing force F acting on the stack of sheets 4 is adjusted in such a manner as to decrease with the decrease in the number of sheets 4 stored. This prevents the occurrence of a problematic situation where, for example, an excessively large pressing force may be applied from the pressing members 9A to a stack of a reduced number of sheets 4 stored and such a stack of sheets 4 may be consequently folded between the support plate 65 and the stacking surfaces 64.

The pressing members 9A having conical shapes are supported in such a manner as to be movable along the respective guide holes 93 each extending at an angle substantially equal to the sloping angle θ of the support surface 66 of the support plate 65. Therefore, regardless of the change in the number of sheets 4 stored, the pressing force F (such as the force F3 or F4) exerted by the pressing members 9A acts on the stack of sheets 4 at a constant angle (in a constant pressing direction). Thus, a stable sheet pressing effect is produced.

Figure 28:
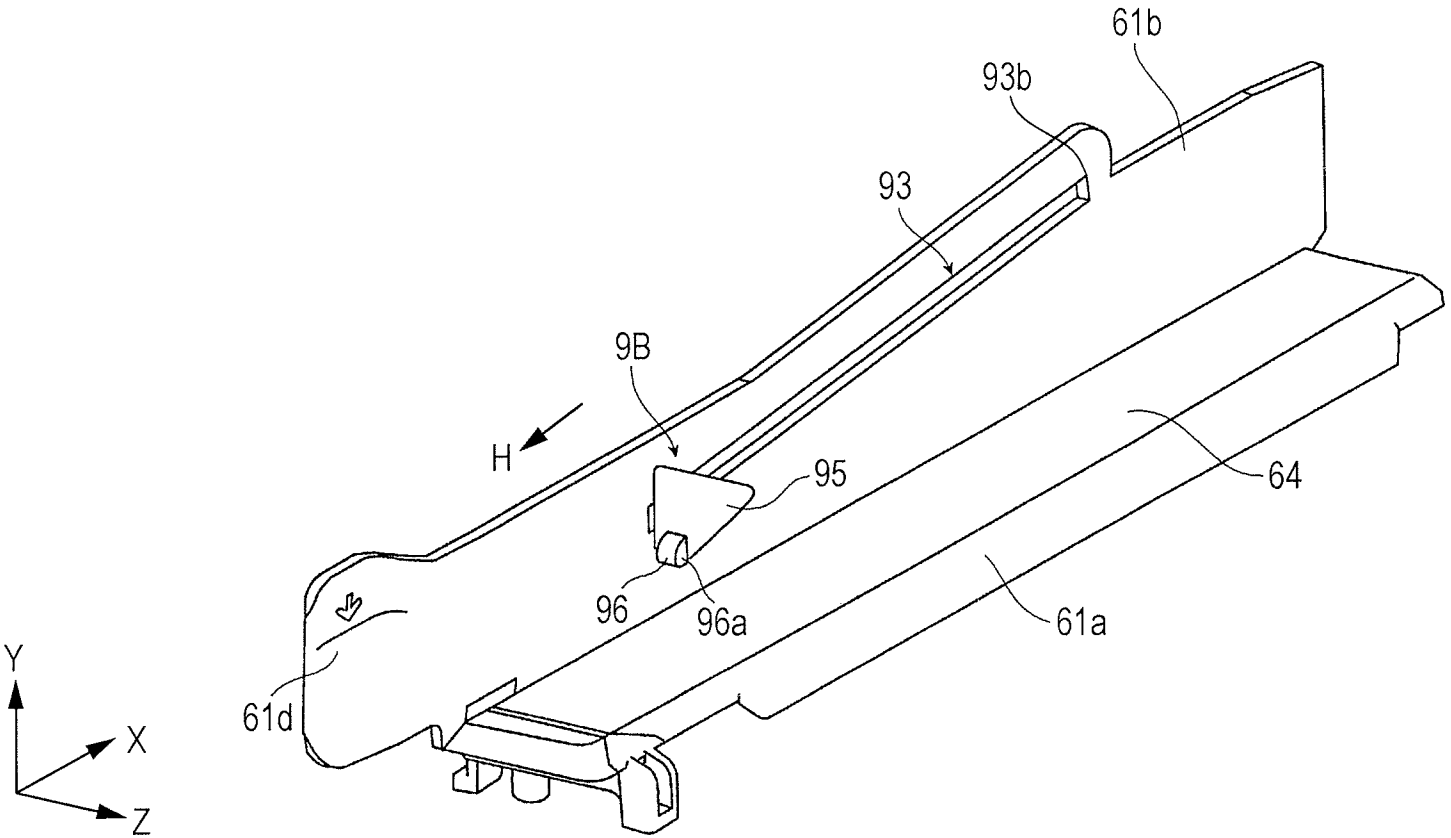
FIG. 28 is a perspective view of one of movable pressing members having another configuration and being at the lowest position.
Figure 29:
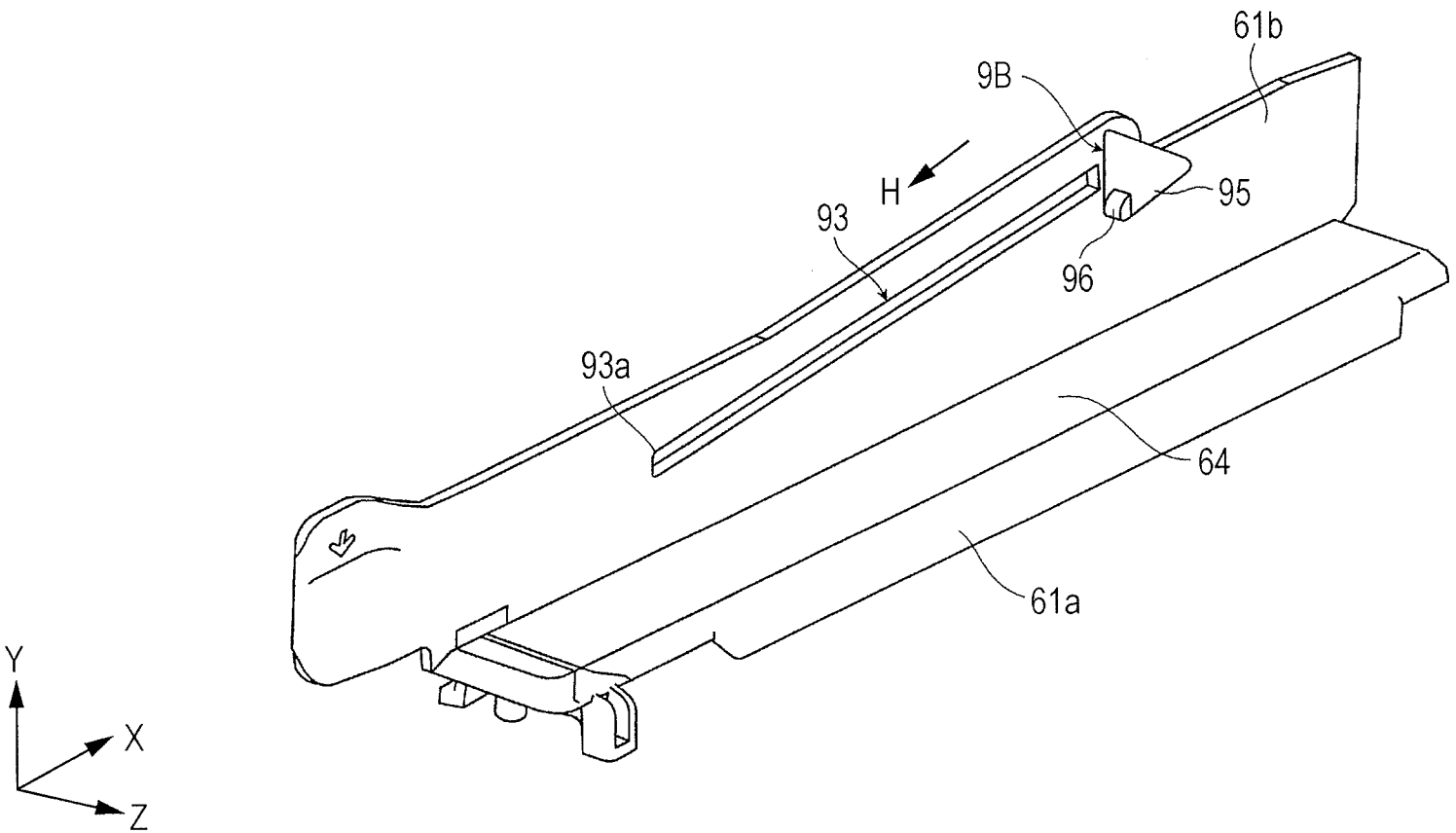
FIG. 29 is a perspective view of the pressing member illustrated in FIG. 28 that is at the highest position.
Figure 30:
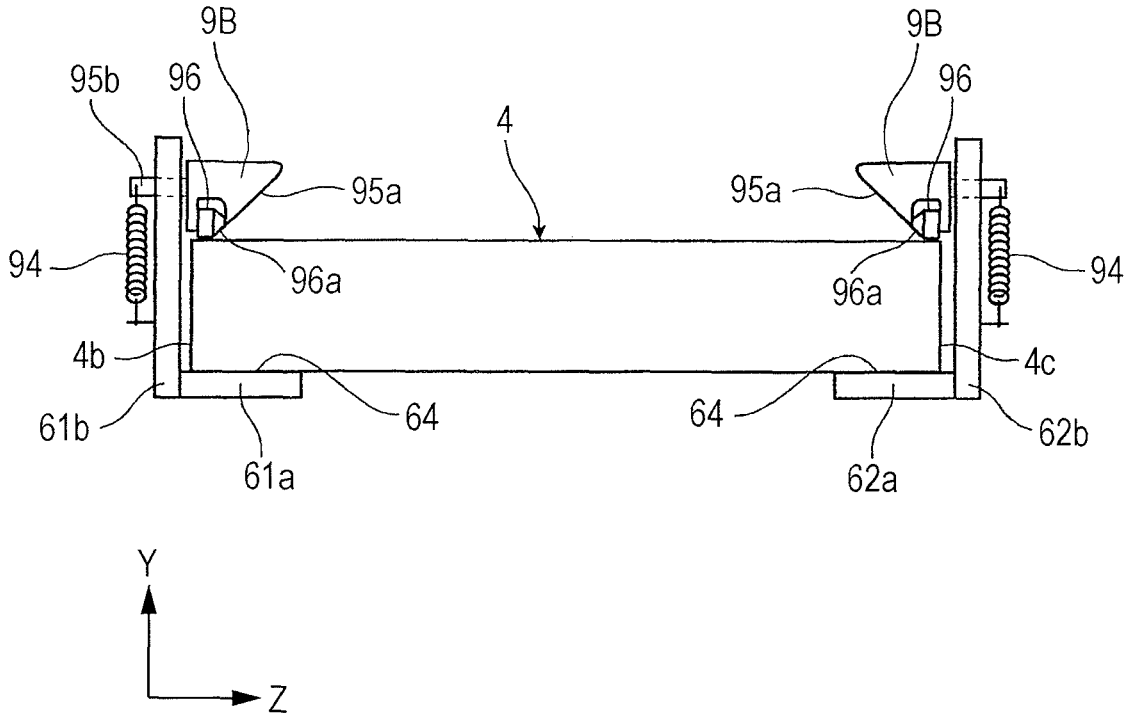
FIG. 30 illustrates a state where the pressing members, one of which is illustrated in FIG. 28, are pressing the sheets.

FIGS. 28 to 30 illustrate movable pressing members 9B, which are different from the pressing members 9A.

The pressing members 9B illustrated in FIG. 28 and others each include, instead of the conical body member 90, a triangular body member 95 and a rotary member 96 rotatably provided at the bottom of the body member 95. The other details of the pressing members 9B are the same as those of the pressing members 9A, which are also movable.

Referring to FIG. 30 and others, the body member 95 of each of the pressing members 9B is a triangular plate member including a sloping portion 95*a* and a support shaft 95*b*. The sloping portion 95*a* slopes upward from the point of contact with a corresponding one of the left and right sides 4*b* and 4*c* of the topmost sheet 4A toward the inner side in the horizontal direction Z. The support shaft 95*b* projects toward a side opposite the side toward which the sloping portion 95*a* extends. The support shaft 95*b* is fitted in a corresponding one of the guide holes 93, whereby the body member 95 of the pressing member 9B is movable along the guide hole 93. The rotary member 96 is a roller member rotatably attached to the bottom of the body member 95 and includes at the inner-side end thereof a sloping surface portion 96*a* sloping at an angle substantially equal to the sloping angle of the sloping portion 95*a* such that the sloping surface portion 96*a* becomes substantially continuous with the sloping portion 95*a*. The body member 95 provided with the rotary member 96 is retained to be pulled toward the lower-side end 93*a* of the guide hole 93 by the coil spring 94 exerting the tensile force H and being hooked on the support shaft 95*b*.

Referring to FIG. 30, the pressing members 9B are used in such a state where the rotary members 96 provided at the bottoms of the respective body portions 95 are in contact with the topmost sheet 4A of the stack of sheets 4 stored. In this state, when the side positioning members 61 and 62 are moved in such directions as to come into contact with the left and right sides 4*b* and 4*c*, respectively, of the sheets 4, the sloping portions 95*a* of the body portions 95 of the pressing members 9B come into contact with the left and right sides 4*b* and 4*c*, respectively, of the topmost sheet 4A and then the body portions 95 move toward higher-side ends 93*b* of the respective guide holes 93 in accordance with the number of sheets 4 stored, whereby the rotary members 96 go over the topmost sheet 4A and stay in contact therewith.

As with the pressing members 9A described above, the pressing members 9B exert an effect of pressing the downstream-side part 4S of the stack of sheets 4 against the sloping surface formed by the support surface 66 of the support plate 65 when the support plate 65 is lifted, whereby each of the sheets 4 is fed in a good manner. As the number of sheets 4 stored decreases, the pressing members 9B gradually move toward the lower-side ends 93*a* of the guide holes 93. Thus, the pressing force F acting on the stack of sheets 4 is controlled to be smaller with the decrease in the number of sheets 4 stored.

Figure 31:
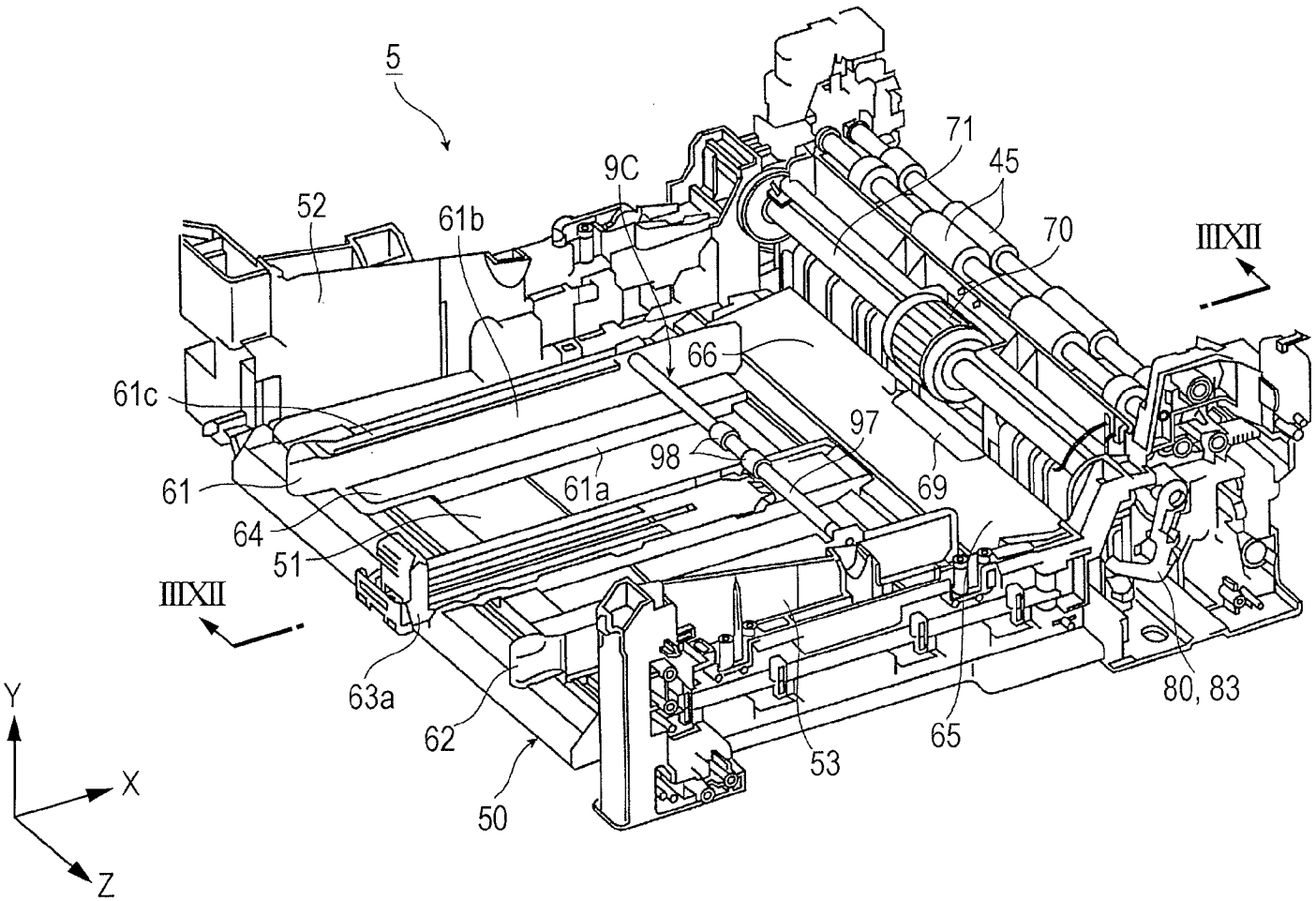
FIG. 31 is a perspective view of a sheet feeding device including a fixed pressing member and in a state where the pressing member is at the lowest position.
Figure 32:
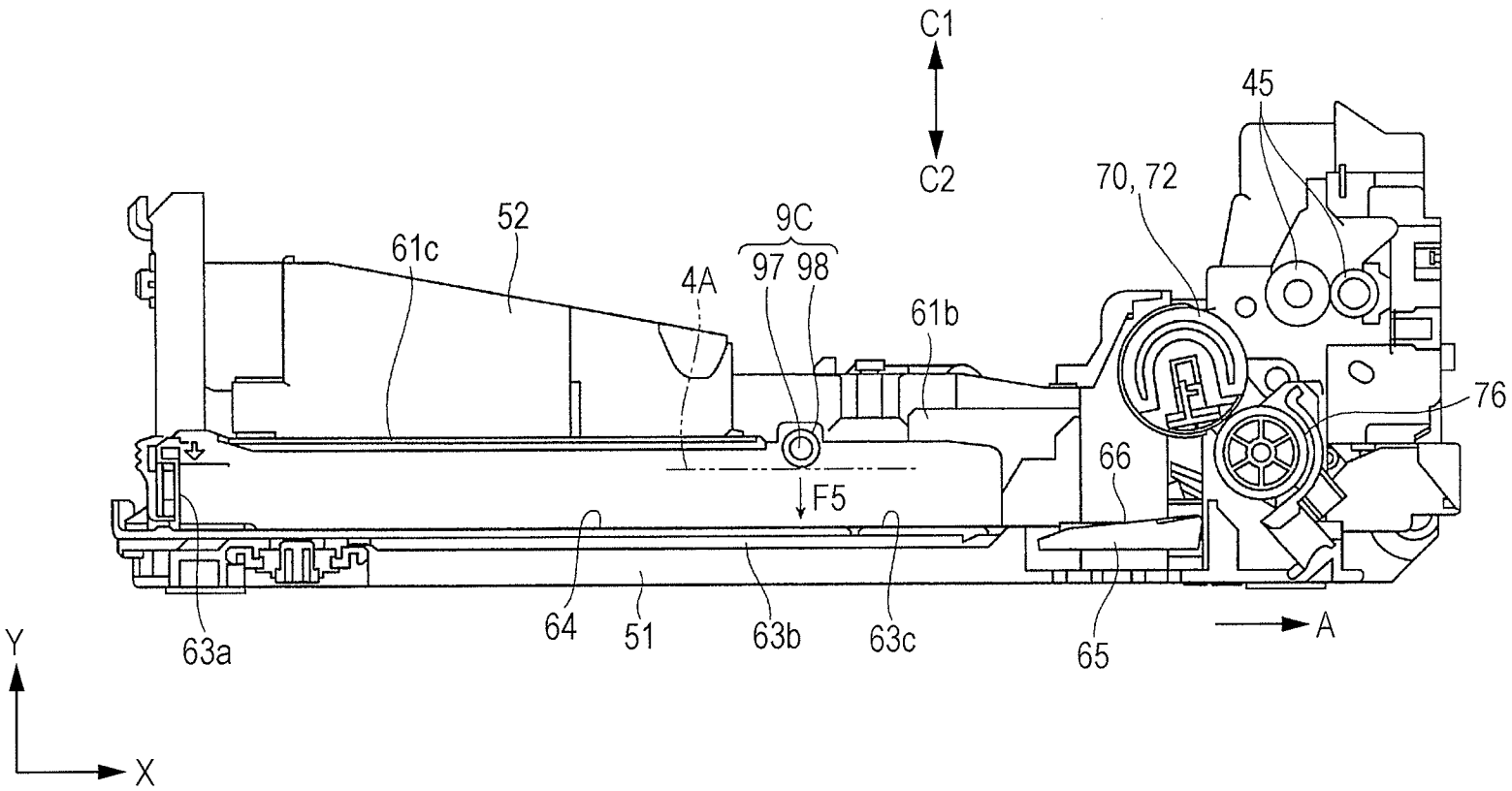
FIG. 32 is a sectional view of the sheet feeding device taken along line IIIXII-IIIXII illustrated in FIG. 31.
Figure 33:
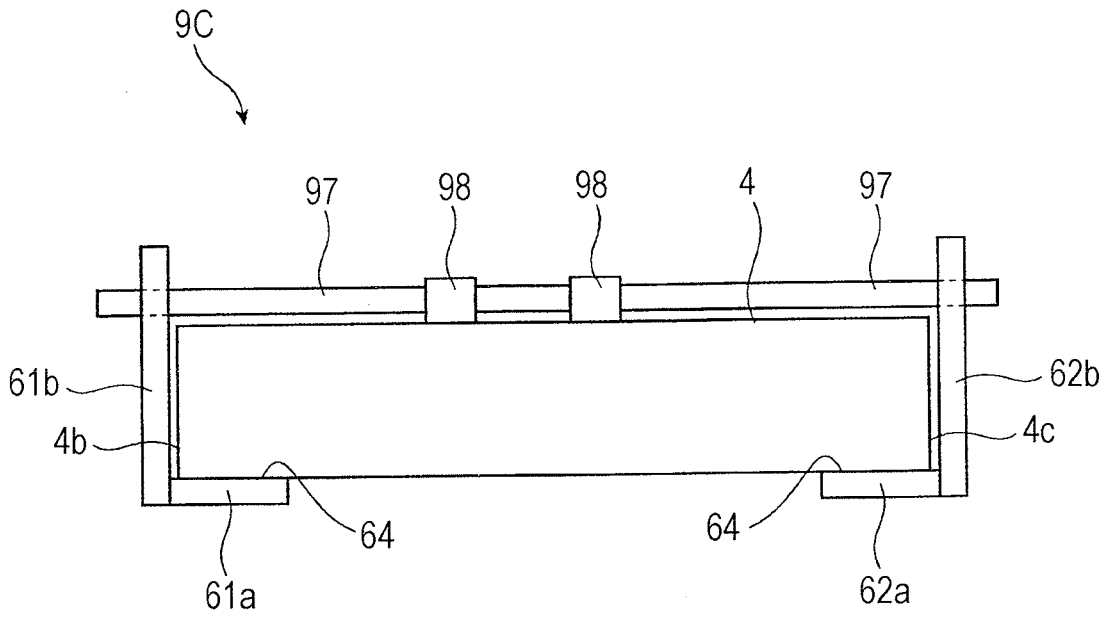
FIG. 33 illustrates a state where the pressing member illustrated in FIG. 31 is pressing a stack of sheets.

FIGS. 31 to 33 illustrate a fixed pressing member 9C.

The pressing member 9C illustrated in FIG. 31 and others includes a support bar 97 extending through the positioning surface portions 61*b* and 62*b* of the side positioning members 61 and 62 and plural rotary members 98 provided substantially in a central part of the support bar 97. The support bar 97 is provided at such a height that, when the maximum storable number of sheets 4 are stored, the rotary members 98 provided thereon come into contact with the topmost sheet 4A (see FIGS. 32 and 33). The side positioning members 61 and 62 are movable in the horizontal direction Z along the support bar 97.

Referring to FIG. 33, the pressing member 9C is configured such that, when the maximum storable number of sheets 4 or a number of sheets 4 close thereto are placed over the stacking surfaces 64 of the side positioning members 61 and 62 in the sheet storing portion 60, the rotary members 98 provided on the support bar 97 come into contact with the topmost sheet 4A of the stack of sheets 4.

The pressing member 9C produces a downward pressing force F5 acting on the stack of sheets 4 at the position where the pressing member 9C is provided. Part of the pressing force F5 acts on the downstream-side part 4S of the stack of sheets 4. Thus, when the support plate 65 is lifted, the pressing member 9C exerts an effect of pressing the downstream-side part 4S of the stack of sheets 4 against the sloping surface formed by the support surface 66 of the support plate 65, whereby each of the sheets 4 is fed in a good manner. Since the rotary members 98 of the pressing member 9C rotatably come into contact with the topmost sheet 4A, the pressing member 9C neither interferes the sheet feeding operation nor triggers misregistration of sheets 4.

In the case of the pressing member 9C, after the number of sheets 4 stored starts to decrease with repeated sheet feeding operations, the rotary members 98 continue to be in contact with the topmost sheet 4A for a while because the sheets 4 are retained to be lifted by the support plate 65. When, however, the number of sheets 4 stored becomes smaller than a specific value, the rotary members 98 of the pressing member 9C become out of contact with the topmost sheet 4A and the pressing effect of the pressing member 9C is not exerted thereafter.

Third Exemplary Embodiment

Figure 34:
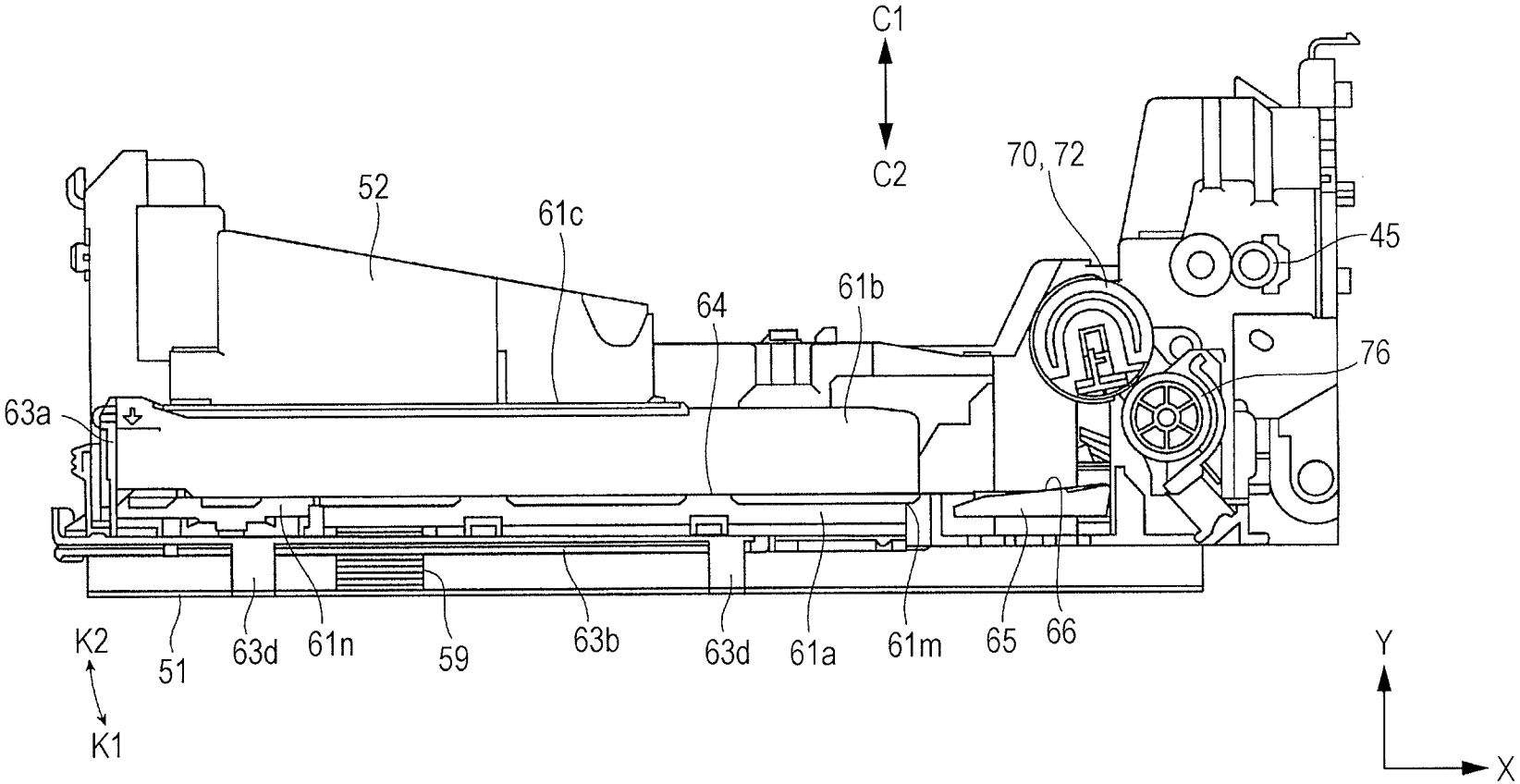
FIG. 34 is a sectional view of a sheet feeding device according to a third exemplary embodiment with lowerable side positioning members thereof being at a standby position.
Figure 35:
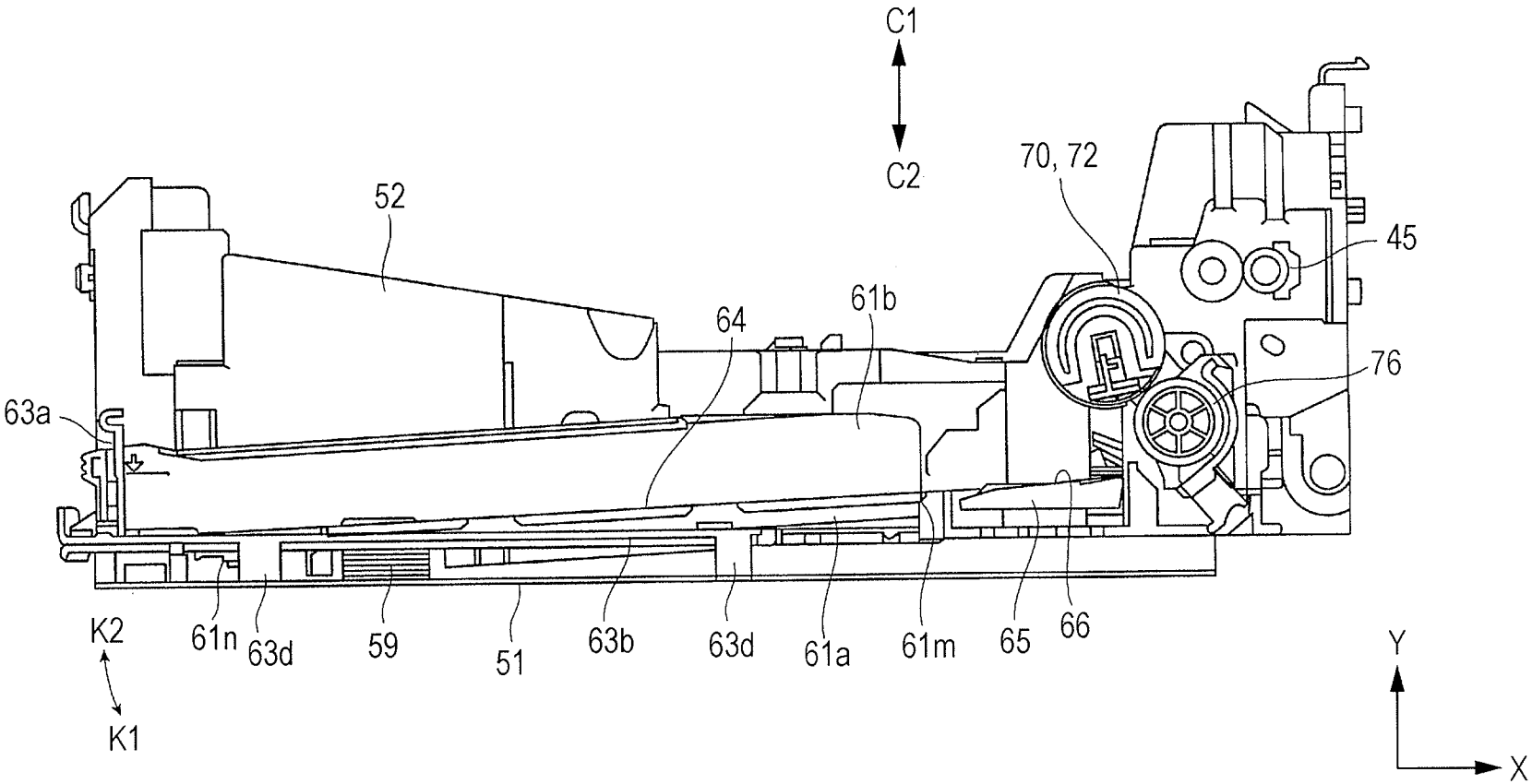
FIG. 35 is a sectional view of the sheet feeding device illustrated in FIG. 34 with the lowerable side positioning members having been lowered.

FIGS. 34 and 35 illustrate a sheet feeding device 5 according to a third exemplary embodiment. The sheet feeding device 5 according to the third exemplary embodiment has the same configuration as the sheet feeding device 5 according to the first exemplary embodiment (see FIG. 4 and others) except that the side positioning members 61 and 62 of the sheet storing portion 60 are lowered with the increase in the number of sheets 4 stored and that the trailing-end-positioning member 63 of the sheet storing portion 60 operates independently of the lowering of the side positioning members 61 and 62. (Hereinafter, reference numerals of the side positioning member 62 and other parts associated therewith are indicated with parentheses, according to need.)

The side positioning member 61 (62) is configured to be lowered in a direction K1 toward the bottom 51 of the support structure 50 with the increase in the number of sheets 4 placed on the stacking surface 64 of the side positioning member 61 (62), with a downstream-side end 61*m* (62*m*) thereof in the sheet feeding direction A functioning as the fulcrum. In the third exemplary embodiment, the downstream-side end 61*m* (62*m*) of the side positioning member (62) is hooked on a corresponding one of the guide grooves 54 in the bottom 51 such that the side positioning member 61 (62) is turnable thereabout. Meanwhile, an upstream-side end 61*n* (62*n*), in the sheet feeding direction A, of the side positioning member 61 (62) is supported by an expandable/contractible spring member (such as a coil spring) 59. From the viewpoints such as providing a space and so forth for lowering the side positioning member 61 (62), the bottom 51 of the support structure 50 is provided at a lower position than the bottom 51 of each of the first and other exemplary embodiments.

The spring member 59 is provided between the bottom surface (back surface) of the base portion 61*a* (62*a*) of the side positioning member 61 (62) and the bottom 51 of the support structure 50 (and at such a position not to interfere with the trailing-end-positioning member 63). The spring member 59 has the upper end thereof fixed to the side positioning member 61 (62) but the lower end thereof not fixed to the bottom 51 of the support structure 50, that is, the lower end is movably in contact with the bottom 51. The spring member 59 does not start to contract before the number of sheets 4 on the stacking surface 64 of the side positioning member 61 (62) exceeds a specific value (50, for example). Thereafter, the amount of contract of the spring member 59 increases with the increase in the number of sheets 4 stored. When the maximum storable number of sheets 4 are stored, the spring member 59 contracts by the largest amount. When no sheets 4 are stored or a small number (for example, few tens) of sheets 4 are stored, the stacking surface 64 of the side positioning member 61 (62) is retained at a reference position, i.e., a standby position, by, for example, coming into contact with a lift preventing projection or the like. When the side positioning member 61 (62) is lowered by the largest amount, the stacking surface 64 thereof slopes at an angle substantially equal to the sloping angle θ of the sloping surface formed by the support surface 66 of the support plate 65.

The trailing-end-positioning member 63 is provided at such a position that the guiding track portion 63*b* thereof resides lower than the stacking surface 64. The trailing-end-positioning member 63 has support legs 63*d*, at which the trailing-end-positioning member 63 is fixed to the bottom 51 of the support structure 50. The positioning surface portion 63*a* of the trailing-end-positioning member 63 is provided at such a height as to be capable of positioning the trailing ends 4*d* of the sheets 4 on the stacking surface 64 of the side positioning member 61 (62) by coming into contact therewith even if the side positioning member 61 (62) is lowered by the largest amount.

The sheet feeding device 5 employing such a lowerable side positioning member 61 (62) operates as follows.

First, sheets 4 to be fed are stored in the sheet storing portion 60 in the same manner as in the first exemplary embodiment. In the storing step, the side positioning member 61 (62) is moved to a position of contact with the left sides 4*b* (the right sides 4*c*) of the sheets 4 placed on the stacking surface 64 thereof. When a number of sheets 4 exceeding a specific value are stored, referring to FIGS. 35 and 36, the side positioning member 61 (62) subjected to the weight (load) of the sheets 4 turns about the downstream-side end 61*m* (62*m*) thereof, that is, the upstream-side end 61*n* (62*n*) thereof is lowered.

Figure 36:
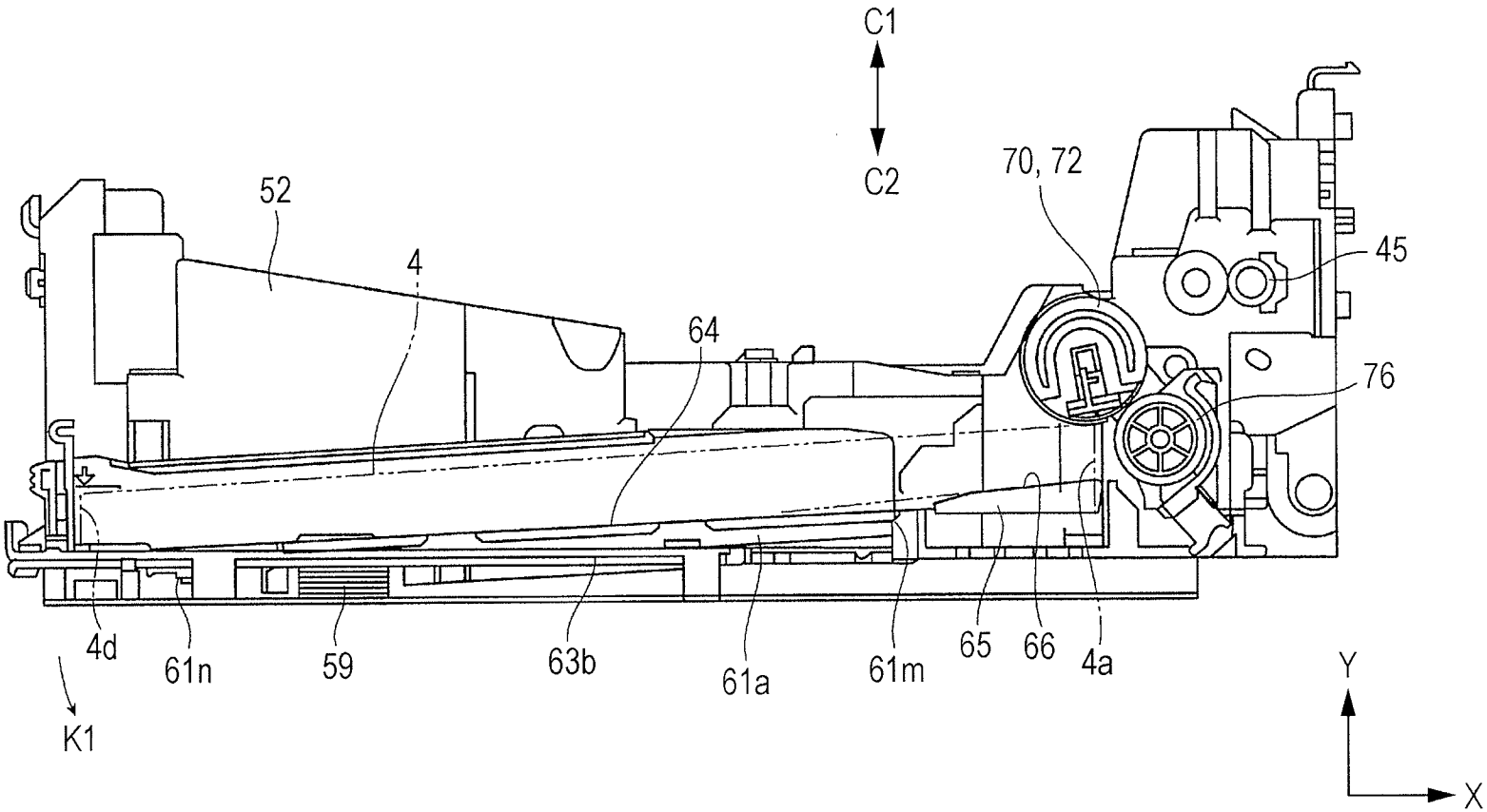
FIG. 36 is a sectional view of the sheet feeding device illustrated in FIG. 34 with sheets stored therein.

When the side positioning member 61 (62) is lowered, the stacking surface 64 thereof is angled with respect to its original orientation at the reference position, i.e., the standby position. Hence, upstream-side part of the stack of sheets 4 on the stacking surface 64 is also angled by being lowered conforming to the stacking surface 64. FIG. 36 illustrates a state where the maximum storable number of sheets 4 or a number of sheets 4 close thereto are stored.

Subsequently, at the time of sheet feeding, referring to FIG. 36, since the support plate 65 is lifted in the lifting direction C1, the downstream-side part 4S of the stack of sheets 4 is lifted and the topmost sheet 4A is thus pressed into contact with the feeding roller 70. In this state, the downstream-side part 4S of the stack of sheets 4 is angled conforming to the sloping surface formed by the support surface 66 of the support plate 65, and the upstream-side part of the stack of sheets 4 supported by the stacking surface 64 is also angled conforming to the stacking surface 64 having been angled. Consequently, the stack of sheets 4 generally slopes at an angle substantially equal to the angle of slope of the downstream-side part 4S.

Thus, even if the maximum storable number of sheets 4 or a number of sheets 4 close thereto are stored, the stack of sheets 4 generally extends substantially flat while sloping at a specific angle, at the time of sheet feeding, by being supported by the support surface 66 of the support plate 65 and the stacking surface 64 of the side positioning member 61 (62) that has been lowered. In this state, the feeding roller 70 performs sheet feeding. Consequently, the approach angle δ of the leading end 4*a* of the topmost sheet 4A into the nip NP (see FIG. 15) is retained to be small. Therefore, each of the sheets 4 is fed in a good manner without being jammed.

In the case where sheet feeding is performed with the maximum storable number of sheets 4 or a number of sheets 4 close thereto placed on the stacking surface 64 of the side positioning member 61 (62) of fixed type as in the first and other exemplary embodiments instead of the lowerable side positioning member 61 (62), referring to FIG. 13, the downstream-side part 4S of the stack of sheets 4 is angled by being supported by the support surface 66 of the support plate 65, whereas the upstream-side part of the stack of sheets 4 (almost all part excluding the downstream-side part 4S) is supported in such a manner as to extend substantially horizontally on the stacking surface 64. Therefore, the stack of sheets 4 is in a generally bent state between the stacking surface 64 and the support plate 65. In contrast, in the case of the lowerable side positioning member 61 (62), the stack of sheets 4 is prevented from becoming such a generally bent state and, even if sheets 4 having relatively high strength are used, the downstream-side part 4S of the stack of sheets 4 is therefore prevented from being lifted and becoming out of contact with the support surface 66 of the support plate 65.

When the number of sheets 4 stored decreases as sheet feeding is repeated and the weight of the sheets 4 decreases, the lowerable side positioning member 61 (62) is lifted in a direction K2 with the spring force exerted by the spring member 59. When the number of sheets 4 stored becomes smaller than a specific value, the side positioning member (62) returns to the standby position and the stacking surface 64 also returns to the reference position, i.e., the standby position.

In the third exemplary embodiment, since the trailing-end-positioning member 63 operates independently of the lowering of the side positioning member 61 (62), the following effect is produced.

Figure 37:
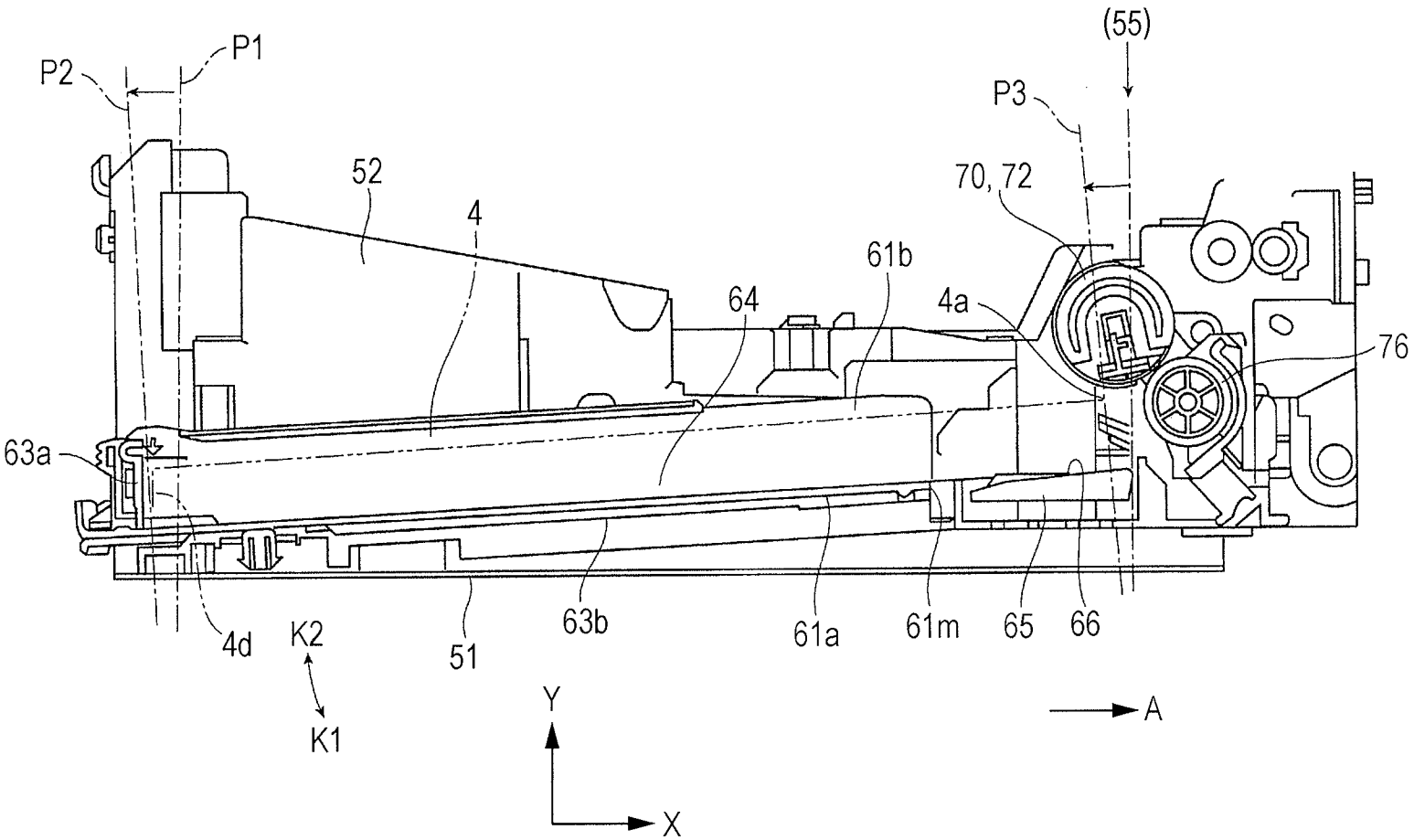
FIG. 37 is a sectional view illustrating a problem arising in a case where a trailing-end-positioning member configured to be lowered in conjunction with the lowering of the lowerable side positioning members is employed.

First, a comparative case where the trailing-end-positioning member 63 operates in conjunction with the lowering of the side positioning member 61 (62) will be considered. Referring to FIG. 37, when sheets 4 are stored and the side positioning member 61 (62) is lowered in the direction K1, the positioning surface portion 63*a* and the guiding track portion 63*b* of the trailing-end-positioning member 63 are also lowered in the direction K1 in such a manner as to turn about a point substantially the same as the downstream-side end 61*m* (62*m*) of the side positioning member 61 (62). With this movement, the positioning surface portion 63*a* of the trailing-end-positioning member 63 is tilted outward (as represented by a line P2) by an amount corresponding to the lowered amount with respect to the initial orientation (represented by a line P1) extending in the perpendicular direction C with respect to the stacking surface 64. Accordingly, the sheets 4 supported by the stacking surface 64 and the support surface 66 slip toward the positioning surface portion 63*a* and the trailing ends 4*d* thereof are aligned along a line tilted in a direction opposite to the sheet feeding direction A. Accordingly, the leading ends 4*a* of the sheets 4 correspondingly aligned along a line (denoted by P3) tilted away from the positioning surface of the leading-end-positioning plate 55 in the direction opposite to the sheet feeding direction A. Consequently, at the time of sheet feeding, the downstream-side part 4S of the stack of sheets 4 lifted by the support plate 65 may not be pressed into contact with the intended point of contact SP on the feeding roller 70 (in this case, the lowest point of the feeding roller 70), leading to failure in sheet feeding.

In contrast, in the case where the trailing-end-positioning member 63 operates independently of the lowering of the side positioning member 61 (62), the above problem does not arise and each of the sheets 4 is fed with no problem.

Modifications of Exemplary Embodiments

In the first to third exemplary embodiments, the stacking surfaces 64 of the sheet feeding device 5 may be angled, not be parallel, with respect to a surface (a level surface, for example) on which the image forming apparatus 1 is installed. In that case, the support plate 65 is configured to be movable in a direction perpendicular to the angled stacking surfaces 64. In the first to third exemplary embodiments, the stopper roller 76 of the sheet feeding device 5 may be substituted by, for example, a braking plate made of a material having a high frictional resistance to the sheet 4.

In the second exemplary embodiment, the rotary members 96 or 98 of the pressing members 9B or the pressing member 9C may be omitted. Furthermore, the pressing member 9C (see FIG. 31 and others) including the support bar 97 having such a length as to extend through both of the positioning surface portions 61*b* and 62*b* of the left and right side positioning members 61 and 62 may be substituted by a pair of support bars (projecting bars) each projecting from a corresponding one of the positioning surface portions 61*b* and 62*b* of the side positioning members 61 and 62 toward the inner side by a specific length (such a length as not to reach the opposite one of the positioning surface portions 61*b* and 62*b*). In that case, the rotary members 98 may be rotatably provided on the support bars having such short lengths, or the rotary members 98 may be omitted. Such a pressing member 9 is not limited to be attached to the positioning surface portions 61*b* and 62*b* of the left and right side positioning members 61 and 62 and may alternatively be attached to, for example, an optional supporting portion provided on the support structure 50.

While the sheet feeding device 5 according to each of the first to third exemplary embodiments is included in the image forming apparatus 1, the sheet feeding device 5 may be provided separately from the image forming apparatus 1 and be used together with the image forming apparatus 1. Alternatively, the sheet feeding device 5 may be provided as a manual sheet feeding device included in the image forming apparatus 1 or the like.

The image forming apparatus 1 employing the sheet feeding device 5 may have any configuration, as long as it includes an image forming section configured to form an image on a sheet 4 and requires a sheet feeding device configured to feed sheets 4 one by one to the image forming section.

The sheet feeding device 5 according to each of the above exemplary embodiments of the present invention may be applied to a sheet handling device that requires a sheet processing section configured to perform specific processing on a sheet and a sheet feeding device configured to feed sheets one by one to the sheet processing section.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

a sheet storing portion having a stacking surface and in which sheets are stacked on the stacking surface;

a feeding roller that rotates to feed each of the sheets in the sheet storing portion while being in contact with a topmost one of the sheets;

a support member having a support surface that is different from the stacking surface of the sheet storing portion and that supports downstream-side part, in a sheet feeding direction in which the feeding roller feeds the sheet, of the sheets in the sheet storing portion from below a bottommost one of the sheets the support member being movable in a substantially perpendicular direction with respect to the stacking surface such that the support surface comes into contact with and moves away from the feeding roller in the substantially perpendicular direction, the support member moving in the substantially perpendicular direction at the time of sheet feeding in such a manner as to lift the downstream-side part of the sheets in the sheet storing portion to contact with the feeding roller; and a stopper member that is out of contact with the support member while being in contact with the feeding roller, the stopper member being configured to come into contact with leading ends of some sheets to be fed by the feeding roller and to stop sheets other than the topmost sheet from being fed, wherein the support surface of the support member forms a sloping surface that slopes upward, with respect to the stacking surface, toward a downstream side in the sheet feeding direction, wherein a sloping angle of the sloping surface with respect to the stacking surface is invariable while the support member is moved in the substantially perpendicular direction.

2. The sheet feeding device according to claim 1, further comprising a pressing member configured to be in contact with the topmost one of the sheets in the sheet storing portion and to press the downstream-side part of the sheets against the sloping surface of the support member when the support member moves.

3. The sheet feeding device according to claim 2, wherein the pressing member is configured such that a position of contact with the topmost sheet, when the feeding roller feeds the sheets, moves toward an upstream side in the sheet feeding direction with the reduction in the number of sheets stored.

4. The sheet feeding device according to claim 3, wherein the stacking surface of the sheet storing portion is turnable downward about a downstream-side end, in the sheet feeding direction, thereof with the increase in the number of sheets stored.

5. The sheet feeding device according to claim 4, wherein the support member is configured such that, when the sheet storing portion is out of sheets, an extension line of the stacking surface intersects the sloping surface at a position higher than a lowest point of the sloping surface.

6. An image forming apparatus comprising:

an image forming section configured to form an image on a sheet; and a sheet feeding device configured to feed sheets one by one to the image forming section, wherein the sheet feeding device is the sheet feeding device according to claim 4.

7. The sheet feeding device according to claim 3, wherein the support member is configured such that, when the sheet storing portion is out of sheets, an extension line of the stacking surface intersects the sloping surface at a position higher than a lowest point of the sloping surface.

8. An image forming apparatus comprising:

an image forming section configured to form an image on a sheet; and a sheet feeding device configured to feed sheets one by one to the image forming section, wherein the sheet feeding device is the sheet feeding device according to claim 3.

9. The sheet feeding device according to claim 2, wherein the stacking surface of the sheet storing portion is turnable downward about a downstream-side end, in the sheet feeding direction, thereof with the increase in the number of sheets stored.

10. The sheet feeding device according to claim 9, wherein the support member is configured such that, when the sheet storing portion is out of sheets, an extension line of the stacking surface intersects the sloping surface at a position higher than a lowest point of the sloping surface.

11. An image forming apparatus comprising:

an image forming section configured to form an image on a sheet; and a sheet feeding device configured to feed sheets one by one to the image forming section, wherein the sheet feeding device is the sheet feeding device according to claim 9.

12. The sheet feeding device according to claim 2, wherein the support member is configured such that, when the sheet storing portion is out of sheets, an extension line of the stacking surface intersects the sloping surface at a position higher than a lowest point of the sloping surface.

13. An image forming apparatus comprising:

an image forming section configured to form an image on a sheet; and a sheet feeding device configured to feed sheets one by one to the image forming section, wherein the sheet feeding device is the sheet feeding device according to claim 2.

14. The sheet feeding device according to claim 2, further comprising a guiding member that is an oblong hole extending in a direction which is substantially parallel to a sloping direction of the sloping surface, the guiding member guiding the pressing member to move back and forth along the hole.

15. The sheet feeding device according to claim 1, wherein the stacking surface of the sheet storing portion is turnable downward about a downstream-side end, in the sheet feeding direction, thereof with the increase in the number of sheets stored.

16. The sheet feeding device according to claim 15, wherein the support member is configured such that, when the sheet storing portion is out of sheets, an extension line of the stacking surface intersects the sloping surface at a position higher than a lowest point of the sloping surface.

17. An image forming apparatus comprising:

an image forming section configured to form an image on a sheet; and a sheet feeding device configured to feed sheets one by one to the image forming section, wherein the sheet feeding device is the sheet feeding device according to claim 15.

18. The sheet feeding device according to claim 1, wherein the support member is configured such that, when the sheet storing portion is out of sheets, an extension line of the stacking surface intersects the sloping surface at a position higher than a lowest point of the sloping surface.

19. An image forming apparatus comprising:

an image forming section configured to form an image on a sheet; and a sheet feeding device configured to feed sheets one by one to the image forming section, wherein the sheet feeding device is the sheet feeding device according to claim 18.

20. An image forming apparatus comprising:

an image forming section configured to form an image on a sheet; and a sheet feeding device configured to feed sheets one by one to the image forming section, wherein the sheet feeding device is the sheet feeding device according to claim 1.

21. The sheet feeding device according to claim 1, wherein the stopper member is a stopper roller.

22. The sheet feeding device according to claim 1, further comprising a pressing member configured to be in contact with the topmost one of the sheets in the sheet storing portion and to directly press a position other than the downstream-side part of the sheets so that the downstream-side part of the sheets is pressed against the sloping surface of the support member when the support member moves.

* * * * *